US010377011B2

(12) United States Patent
Obayashi

(10) Patent No.: US 10,377,011 B2
(45) Date of Patent: Aug. 13, 2019

(54) EYEGLASS LENS PROCESSING APPARATUS AND EYEGLASS LENS PROCESSING PROGRAM

(71) Applicant: NIDEK CO., LTD., Gamagori, Aichi (JP)

(72) Inventor: Hirokatsu Obayashi, Toyokawa (JP)

(73) Assignee: NIDEK CO., LTD., Gamagori, Aichi (JP)

( * ) Notice: Subject to any disclaimer, the term of this patent is extended or adjusted under 35 U.S.C. 154(b) by 969 days.

(21) Appl. No.: 14/317,205

(22) Filed: Jun. 27, 2014

(65) Prior Publication Data

US 2015/0004884 A1 Jan. 1, 2015

(30) Foreign Application Priority Data

Jun. 28, 2013 (JP) ..... 2013-137434

(51) Int. Cl.
*B24B 9/14* (2006.01)

(52) U.S. Cl.
CPC ..... *B24B 9/148* (2013.01)

(58) Field of Classification Search
CPC ..... B24B 9/148
See application file for complete search history.

(56) References Cited

U.S. PATENT DOCUMENTS 6,062,947 A * 5/2000 Obayashi ..... B24B 9/14 451/255
6,099,383 A * 8/2000 Mizuno ..... B24B 9/148 451/256

(Continued)

FOREIGN PATENT DOCUMENTS

EP 2 529 885 A2 12/2012
EP 2 636 484 A2 9/2013
JP 5-131350 A 5/1993
JP 11-309657 A 11/1999

(Continued)

OTHER PUBLICATIONS

Search Report dated Jan. 12, 2015 issued by the European Patent Office in counterpart European Patent Application No. 14002216.1.
Office Action dated Mar. 21, 2017 issued by the Japanese Patent Office in counterpart Japanese Patent Application No. 2013-137434.

*Primary Examiner* — Monica S Carter
*Assistant Examiner* — Marcel T Dion
(74) *Attorney, Agent, or Firm* — Sughrue Mion, PLLC

(57) ABSTRACT

There is provided an eyeglass lens processing apparatus including a first rotational shaft which holds and rotates an eyeglass lens, a finishing tool, a chamfering tool which performs chamfering on an angular portion of an edge of the eyeglass lens, a second rotational shaft to which the chamfering tool is attached, an adjustment unit which adjusts a relative positional relationship between the first rotational shaft and the second rotational shaft, a chamfering angle setting portion which sets a chamfering angle formed between a rotational center axis of the first rotational shaft and a processing tool surface, an edge information acquisition portion which acquires information regarding an edge surface shape of the eyeglass lens, an angle correction portion which corrects the chamfering angle based on the information regarding the edge surface shape, and a control portion which controls the adjustment unit and performs chamfering based on the corrected chamfering angle.

20 Claims, 16 Drawing Sheets

(56) References Cited

U.S. PATENT DOCUMENTS

| | | | | |
|---|---|---|---|---|
| 6,336,057 | B1 * | 1/2002 | Obayashi | B24B 9/148 451/43 |
| 2002/0022436 | A1 * | 2/2002 | Mizuno | B24B 9/148 451/10 |
| 2004/0097168 | A1 * | 5/2004 | Igarashi | B23C 3/12 451/5 |
| 2006/0073772 | A1 * | 4/2006 | Shibata | B24B 49/00 451/52 |
| 2006/0240747 | A1 * | 10/2006 | Natsume | B23C 3/12 451/5 |
| 2007/0298686 | A1 * | 12/2007 | Shibata | B23C 3/04 451/5 |
| 2009/0142993 | A1 * | 6/2009 | Obayashi | B24B 9/148 451/9 |
| 2009/0247051 | A1 * | 10/2009 | Obayashi | B24B 9/148 451/5 |
| 2010/0093265 | A1 * | 4/2010 | Lemaire | B24B 9/14 451/294 |
| 2010/0136885 | A1 * | 6/2010 | Takeichi | B24B 51/00 451/5 |
| 2011/0076923 | A1 * | 3/2011 | Takeichi | B24B 9/14 451/5 |
| 2012/0252315 | A1 * | 10/2012 | Natsume | B24B 9/14 451/5 |
| 2013/0232774 | A1 | 9/2013 | Nakako et al. | |

FOREIGN PATENT DOCUMENTS

| | | | |
|---|---|---|---|
| JP | 2006-95684 | A | 4/2006 |
| JP | 2012-250297 | A | 12/2012 |

* cited by examiner

EYEGLASS LENS PROCESSING APPARATUS AND EYEGLASS LENS PROCESSING PROGRAM

CROSS-REFERENCE TO RELATED APPLICATION

This application claims priority from Japanese Patent Application No. 2013-137434, filed on Jun. 28, 2013, the entire subject matter of which is incorporated herein by reference.

TECHNICAL FIELD

The present invention relates to an eyeglass lens processing apparatus and an eyeglass lens processing program which perform processing of a rim of an eyeglass lens.

BACKGROUND

As an eyeglass lens processing apparatus, for example, there is known an eyeglass lens processing apparatus which performs processing of an eyeglass lens using a grinding tool or a cutting tool (for example, JP-A-2006-095684 and JP-A-2012-250297).

For example, the eyeglass lens processing apparatus disclosed in JP-A-2006-095684 is an apparatus which performs grinding processing of a rim of an eyeglass lens held by chuck shafts using a grindstone so as to have a shape matching a target shape of the lens of an eyeglass frame.

For example, the eyeglass lens processing apparatus disclosed in JP-A-2012-250297 performs processing of an eyeglass lens using the cutting tool.

Since an eyeglass lens in which finishing is performed by the eyeglass lens processing apparatus has an angular portion on an edge, chamfering is performed. There has been proposed an eyeglass lens processing apparatus which includes a chamfering tool to remove the angular portion.

SUMMARY

Incidentally, for example, there is an eyeglass lens processing apparatus in which beveling or plano-processing of an eyeglass lens is performed by tilting a rotational shaft of a beveling tool or a plano-processing tool with respect to a rotational center axis of an eyeglass lens when performing processing (inclined processing) of a lens having a large curvature, called a highly curved lens.

However, in the related-art processing apparatus, a chamfering angle corresponds to a fixed angle or an angle input by an operator. Therefore, for example, when performing chamfering to a lens in which the inclined processing is performed, a processing tool surface of a chamfering tool does not come into contact with an angular portion where an edge is formed, at a proper angle, and thus, there is a possibility that the angular portion may not be completely eliminated. Even in a lens in which the inclined processing is not performed, when the edge varies in thickness, there may be a possibility of an occurrence of the similar problem.

The present invention has been made in view of the above-described problems, and one of the technical subjects of the present invention is to provide an eyeglass lens processing apparatus and an eyeglass lens processing program which can appropriately perform the chamfering.

According to an embodiment of the present application, an eyeglass lens processing apparatus comprise:

a first rotational shaft which is configured to hold and rotate an eyeglass lens;

a finishing tool which is configured to perform finishing on a rim of the eyeglass lens to have a target shape of the eyeglass lens;

a chamfering tool which is configured to perform chamfering on an angular portion of an edge of the eyeglass lens which is finished by the finishing tool;

a second rotational shaft, to which the chamfering tool is attached;

an adjustment unit which is configured to adjust a relative positional relationship between the first rotational shaft and the second rotational shaft;

a control portion which is configured to control driving of the adjustment unit;

a chamfering angle setting portion which is configured to set a chamfering angle which is an angle formed between a rotational center axis of the first rotational shaft and a processing tool surface of the chamfering tool when performing the chamfering;

an edge information acquisition portion which is configured to acquire information regarding an edge surface shape of the eyeglass lens; and an angle correction portion which is configured to correct the chamfering angle which is set by the chamfering angle setting portion, based on the information regarding the edge surface shape which is acquired by the edge information acquisition portion, wherein the control portion is configured to control the driving of the adjustment unit and adjust the relative positional relationship between the first rotational shaft and the second rotational shaft to perform the chamfering, based on the chamfering angle which is corrected by the angle correction portion.

According to another embodiment of the present application, a non-transitory storage medium has an eyeglass lens processing program stored thereon and readable by a processor of an eyeglass lens processing apparatus, the eyeglass lens processing program, when executed by the processor, causing the eyeglass lens processing apparatus to:

when performing chamfering on an angular portion of an edge of an eyeglass lens which is finished by a finishing tool, set a chamfering angle which is an angle formed between a rotational center axis of a first rotational shaft which is configured to hold and rotate the eyeglass lens and a processing tool surface of a chamfering tool which is configured to perform chamfering on the angular portion of the edge of the eyeglass lens;

acquire information regarding an edge surface shape of the eyeglass lens with respect to the first rotational shaft;

correct the chamfering angle based on the information regarding the edge surface shape which is acquired by the acquiring step; and control driving of an adjustment unit which is configured to adjust a relative positional relationship between the first rotational shaft and a second rotational shaft to which the chamfering tool is attached so as to adjust the relative positional relationship between the first rotational shaft and the second rotational shaft based on the chamfering angle which is corrected by the correcting step.

DETAILED DESCRIPTION

<Embodiment>

Figure 1A:
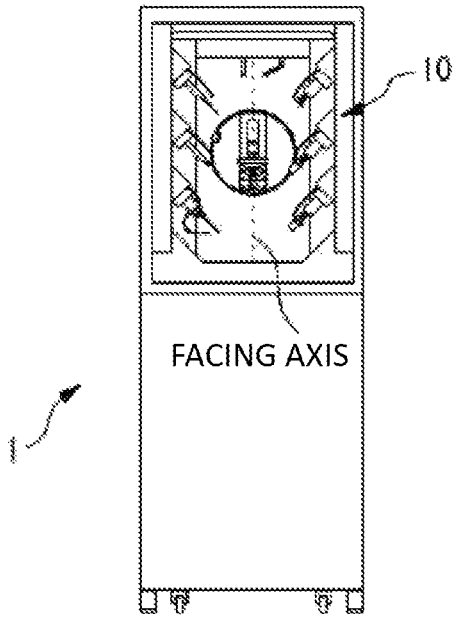
FIGS. 1A and 1B are schematic configuration diagrams of an apparatus body of an eyeglass lens processing apparatus.
Figure 1B:
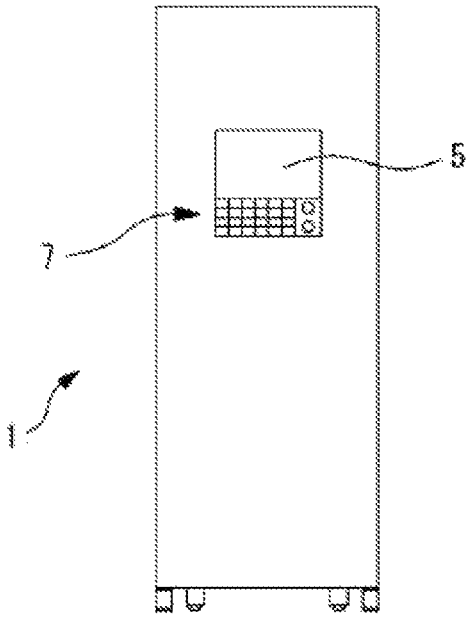

An embodiment of the present invention will be described with reference to the drawings. FIGS. 1A and 1B are schematic configuration diagrams of an eyeglass lens processing apparatus (hereinafter, abbreviated to a processing apparatus) 1 according to the present embodiment. FIG. 1A is the schematic configuration diagram of the processing apparatus 1 when seen from the front. FIG. 1B is the schematic configuration diagram of the processing apparatus 1 when seen from the rear. In an upper portion of the processing apparatus, there is provided a lens processing section 10 which performs processing of a lens.

Figure 2:
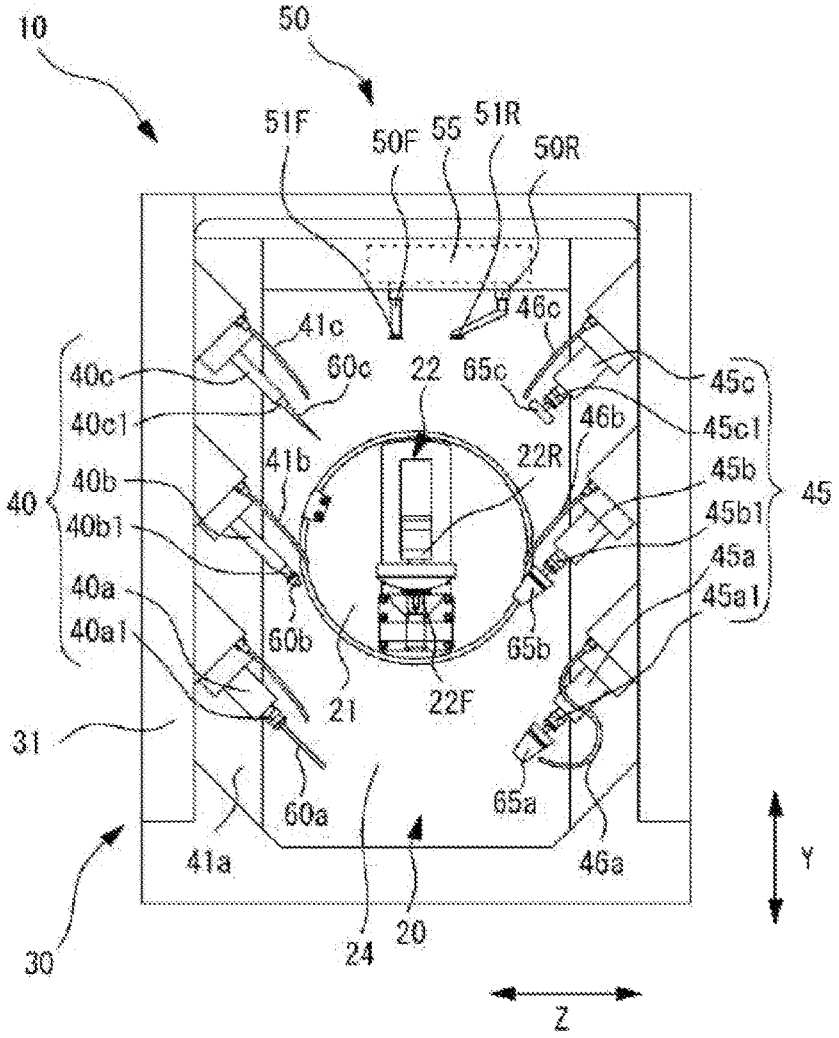
FIG. 2 shows a schematic configuration of a lens processing section.

FIG. 2 shows a schematic configuration diagram of the lens processing section 10. A configuration of the lens processing section 10 will be described. The lens processing section 10 includes a lens chuck unit 20 and a spindle holding unit 30.

In the apparatus of the present embodiment, descriptions will be given while a vertical direction of the eyeglass lens processing apparatus 1 is referred to as a Y-axis direction, a front-rear direction thereof is referred to as an X-axis direction, and a lateral direction is referred to as a Z-axis direction, when seen from the front.

<Lens Chuck Unit>

The lens chuck unit 20 holds an eyeglass lens (hereinafter, abbreviated to a lens) LE and moves the lens LE with respect to the spindle holding unit 30. The lens chuck unit 20 includes a carriage 21 and a base 24. The carriage 21 includes a pair of first rotational shafts 22 (22F and 22R) which hold and rotate the lens LE. The first rotational shafts 22 rotate about a rotational center axis L2 (refer to FIGS. 8A and 8B) described below.

Figure 3:
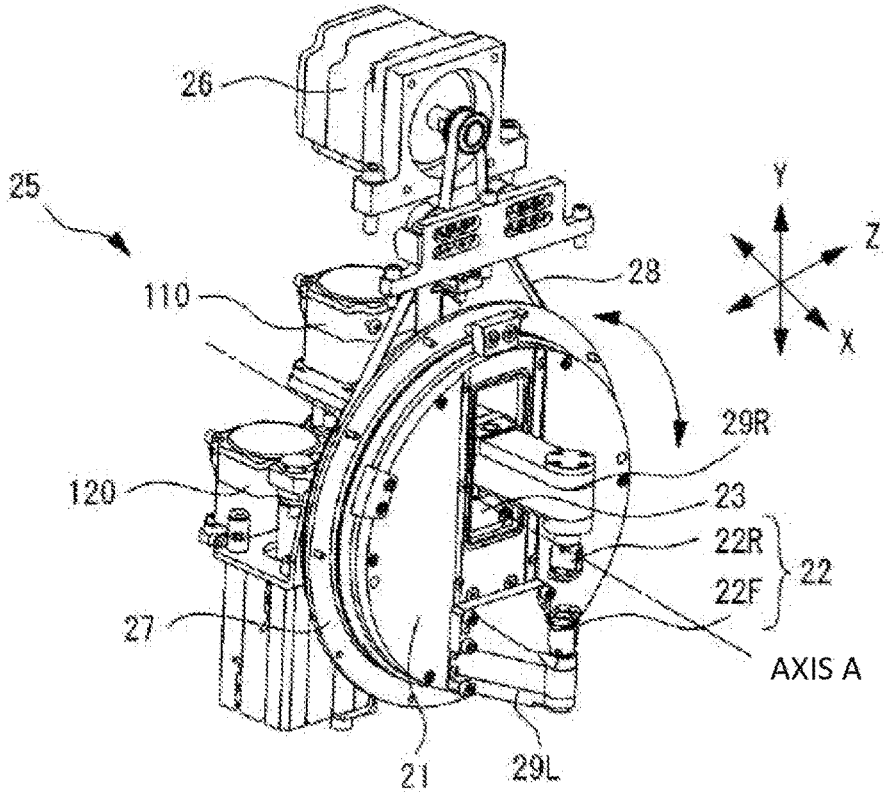
FIG. 3 is a schematic configuration diagram of a lens chuck unit.

FIG. 3 is a schematic configuration diagram of the lens chuck unit 20. A holding arm 29L which holds a first rotational shaft 22F to be rotatable is fixed to the front side of the carriage 21. On the rear surface of the carriage 21, there is provided a chuck table 23 which is movable on two guide rails (not shown) extending laterally. A holding arm 29R which holds a first rotational shaft 22R to be rotatable is fixed to the chuck table 23. In the chuck table 23, there is provided a pressure driving source (not shown) which moves the chuck table 23 in parallel to the first rotational shafts 22 in the chuck table 23. The pressure driving source includes an air pump, a valve, a piston, and the like. The air pump is used to forcedly supply air. The piston is fixed to the chuck table 23. The valve is provided in a hermetically sealed space where the piston is arranged. Introduction of air to the hermetically sealed space is adjusted by opening and closing of the valve. The pressure driving source moves the piston in parallel to the rotational center axis L2 (refer to FIGS. 8A and 8B) by adjusting the introduction of air to the hermetically sealed space. Accordingly, the holding arm 29R and the first rotational shaft 22R together with the chuck table 23 makes a parallel movement toward the first rotational shaft 22F provided in the carriage 21. Then, the eyeglass lens LE is held by the first rotational shaft 22F and the first rotational shaft 22R. The first rotational shaft 22F and the first rotational shaft 22R are arranged in a coaxial relationship.

In the lens chuck unit 20, there is provided a driving source (for example, a motor) 110. The motor 110 is used to rotate the first rotational shaft 22R about the axis thereof. The first rotational shaft 22R rotates on account of rotational driving of the motor 110 via a rotation transmission mechanism such as a timing belt and a pulley In the lens chuck unit 20, there is provided a driving source (for example, a motor) 120. The motor 120 is used to rotate the first rotational shaft 22F about the axis thereof. The first rotational shaft 22F rotates on account of rotational driving of the motor 120 via the rotation transmission mechanism such as the timing belt and the pulley. Encoders which detect rotational angles of the first rotational shafts 22F and 22R are attached to rotational shafts of the motors 110 and 120. The motors 110 and 120 are synchronously driven. In other words, the first rotational shafts 22F and 22R are synchronously and rotationally driven. These configure a lens rotation unit.

<Carriage Rotation Driving Mechanism>

In the lens chuck unit 20, there is provided a shaft angle change mechanism (a shaft angle change portion) 25. The shaft angle change mechanism 25 is used to adjust a relative positional relationship between the first rotational shafts 22 and a processing tool when switching the processing tool or processing an eyeglass lens (details thereof will be described later). The shaft angle change portion 25 may be used as an adjustment unit which adjusts a relative positional relationship between the first rotational shafts 22 and a second rotational shaft. In the present embodiment, the second rotational shaft is concurrently used as a third rotational shaft. Therefore, an X-axis driving mechanism 80 and a Z-axis driving mechanism 85 may be used as a bevel-finishing tool adjustment unit which adjusts a relative positional relationship between the first rotational shafts 22 and a third rotational shaft (a second rotational shaft) 45*b*1.

The shaft angle change mechanism 25 includes a driving source (for example, a motor) 26, a pulley 27, and a timing belt 28. The carriage 21 is fixed to the pulley 27. When the motor 26 is rotationally driven, rotations of the motor 26 are transmitted to the pulley 27 via the timing belt 28. When the pulley 27 rotates, the carriage 21 is rotationally driven having the center axis (an axis A) of the carriage 21 as a rotational center with respect to the base 24. Accordingly, in accordance with the rotational driving of the carriage 21, a shaft angle of the first rotational shafts 22 changes with (pivots on) the axis A as the center. In the present embodiment, an initial position of the carriage 21 at the time of beginning of rotations is set to a position in which axis directions of the first rotational shafts 22F and 22R have axes parallel to the Y-axis direction when the eyeglass lens is held by the first rotational shafts 22F and 22R (refer to FIG. 11A). In this case, the first rotational shafts 22F and 22R are positioned so as to cause the first rotational shaft 22R to be on an upper side and to cause the first rotational shaft 22F to be on a lower side. In other words, a concave surface (a rear surface) of the eyeglass lens LE is the upper side, and a convex portion (a front surface) of the eyeglass lens LE is the lower side. The first rotational shaft 22F is the front surface side of the lens LE, and the first rotational shaft 22R is the rear surface side of the lens LE.

<X-Axis and Z-Axis Driving Mechanisms>

Figure 4:
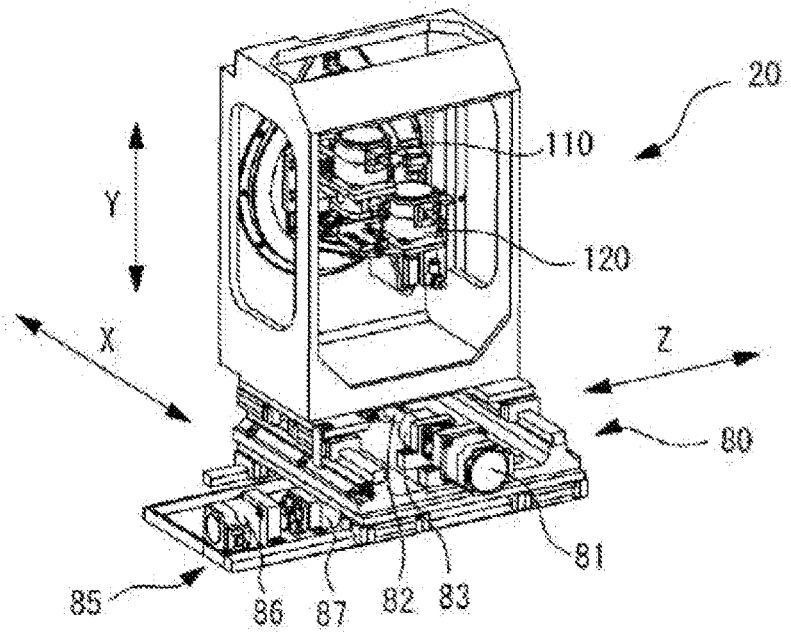
FIG. 4 is a diagram showing a drive mechanism of the lens chuck unit in an X-axis direction and a Z-axis direction.

FIG. 4 is a diagram showing a driving mechanism of the lens chuck unit 20 in the X-axis direction and the Z-axis direction. In the lens chuck unit 20, there are provided driving mechanisms (the X-axis driving mechanism 80 and the Z-axis driving mechanism 85) which move the lens chuck unit 20 respectively in the X-axis direction and the Z-axis direction with respect to the spindle holding unit 30. The X-axis driving mechanism 80 and the Z-axis driving mechanism 85 may be used as the adjustment unit which adjusts a relative positional relationship between the first rotational shafts 22 and a second rotational shaft 65*b*1. In the present embodiment, the second rotational shaft is concurrently used as the third rotational shaft. Therefore, the X-axis driving mechanism 80 and the Z-axis driving mechanism 85 may be used as a bevel-finishing tool adjustment unit which adjusts a relative positional relationship between the first rotational shafts 22 and the third rotational shaft (the second rotational shaft) 45*b*1.

The X-axis driving mechanism 80 includes a driving source (a motor) 81. A shaft 82 which extends in the X-axis direction is directly connected to the motor 81. An encoder which detects a movement position of the lens chuck unit 20 in the X-axis direction is attached to a rotational shaft of the motor 81. A screw groove is formed on an outer periphery of the shaft 82. A movement member (for example, a nut) (not shown) as a bearing is fit to the tip of the shaft 82. The lens chuck unit 20 is fixed to the movement member. When the motor 81 is rotationally driven, the lens chuck unit 20 moves along the shaft 82 extending in the X-axis direction. Accordingly, the first rotational shafts 22F and 22R linearly move in the X-axis direction together with the carriage 21.

The Z-axis driving mechanism 85 includes a driving source (a motor) 86. A shaft (not shown) which extends in the Z-axis direction is directly connected to the motor 86. An encoder which detects a movement position of the lens chuck unit 20 in the Z-axis direction is attached to a rotational shaft of the motor 86. A screw groove is formed on an outer periphery of the shaft. A movement member (for example, a nut) (not shown) as a bearing is fit to the tip of the shaft. The lens chuck unit 20 is fixed to the movement member. When the motor 86 is rotationally driven, the lens chuck unit 20 moves along the shaft extending in the Z-axis direction. Accordingly, the first rotational shafts 22F and 22R linearly move in the Z-axis direction together with the carriage 21.

<Spindle Holding Unit>

As in FIG. 2, the spindle holding unit 30 includes a movement support base 31, a first processing tool unit 40 and a second processing tool unit 45 on the right and left side surfaces, and lens shape measurement units 50F and 50R. The first processing tool unit 40 and the second processing tool unit 45 are arranged on the right and left side surfaces of the movement support base 31.

<Processing Unit>

As shown in FIG. 2, the first processing tool unit 40 is arranged on the left side surface of the movement support base 31 and includes three spindles 40*a*, 40*b*, and 40*c*. The second processing tool unit 45 is arranged on the right side surface of the movement support base 31 and includes three spindles 45*a*, 45*b*, and 45*c*. The spindles 40*a*, 40*b*, and 40*c* of the first processing tool unit 40 respectively have rotational shafts 40*a*1, 40*b*1, and 40*c*1 to rotate the processing tools, respectively. Each of processing tools 60*a*, 60*b*, and 60*c* is attached to the same shaft as each of the rotational shafts. The spindles 45*a*, 45*b*, and 45*c* of the second processing tool unit 45 respectively have rotational shafts 45*a*1, 45*b*1, and 45*c*1 to rotate the processing tools, respectively. Each of processing tools 65*a*, 65*b*, and 65*c* is attached to the same shaft as each of the rotational shafts. Each of the processing tools is used as a processing tool to perform processing of an eyeglass lens. The rotational shafts of the spindles rotate by the drive sources (for example, the motors) which are respectively arranged at the rear portion of each of the spindles via the rotation transmission mechanisms which are respectively arranged inside the spindles.

For example, in the present embodiment, an end mill or a cutter as a roughing tool is arranged in the processing tool 60*a*. The processing tool 60*a* is used to perform cutting of an unprocessed eyeglass lens LE prior to finishing. A cutter as a groove-finishing tool (a grooving tool) is arranged in the processing tool 60*b*. An end mill as a drilling tool to drill a hole on a refractive surface of the lens LE is arranged in the processing tool 60*c*. A polishing stone as a polishing tool is arranged in the processing tool 65*a*. The polishing tool is used to polish a mirror surface of the eyeglass lens LE using water. A conical-shaped cutter as a finishing tool is arranged in the processing tool 65*b*. The finishing tool 65*b* may be a finishing tool which performs finishing of a rim of an eyeglass lens to have a target shape of the lens. A bevel groove (a V-groove) to form a bevel on an edge of the lens LE and a plano-processing surface to perform plano-processing of a periphery of the lens LE are formed in the finishing tool 65*b*, which is used to perform beveling and flat-finishing of a roughed lens rim. That is, the finishing tool 65*b* may be used as a bevel-finishing tool to form a bevel on an edge of the lens LE. The finishing tool 65*b* (the plano-processing surface) is concurrently used as a chamfering tool to perform chamfering in an angular portion on an edge of the eyeglass lens which is finished by a finishing tool.

In the following description, the rotational shaft which rotates the chamfering tool is referred to as the second rotational shaft, and the rotational shaft which causes the beveling tool to rotate is referred to as the third rotational shaft. In the present embodiment, since the chamfering tool and the beveling tool are concurrently used as the finishing tool 65*b*, the second rotational shaft and the third rotational shaft are concurrently used as the rotational shaft 45*b*1.

A step-processing tool to further perform step-processing of a beveled rim of the lens is arranged in the processing tool 65*c*.

In the vicinities of the spindles, there are respectively provided hoses 41*a*, 41*b*, 41*c*, 46*a*, 46*b*, and 46*c* to supply air or water. The hoses 41*a*, 41*b*, 41*c*, 46*b*, and 46*c* are used to remove cut pieces by air after processing the eyeglass lens. The hose 46*a* is used to supply water. The hose 46*a* is used to supply water which is used when processing the eyeglass lens.

Each of the spindles is arranged so as to tilt the tip end of the spindle downward (toward the gravity direction). In the present embodiment, each of the spindles is arranged such that a tilt angle thereof is 45° downward from the Z-axis direction (a horizontal direction).

<Y-Axis Driving Mechanism>

Figure 5:
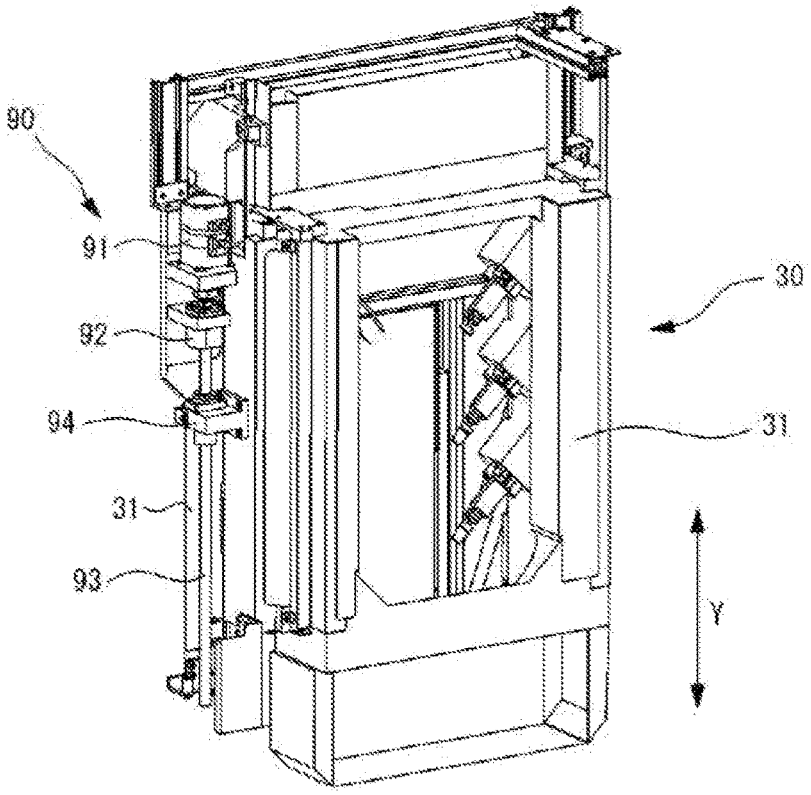
FIG. 5 is a diagram showing a drive mechanism of a spindle holding unit in a Y-axis direction.

FIG. 5 is a diagram showing a driving mechanism of the spindle holding unit 30 in the Y-axis direction. In the spindle holding unit 30, there is provided a driving mechanism (a Y-axis driving mechanism 90) which moves the spindle holding unit 30 in the Y-axis direction with respect to the lens chuck unit 20. The Y-axis driving mechanism 90 may be used as an adjustment unit which adjusts a relative positional relationship between the first rotational shafts 22 and the second rotational shaft 45*b* 1. In the present embodiment, the second rotational shaft is concurrently used as the third rotational shaft. Therefore, the X-axis driving mechanism 80 and the Z-axis driving mechanism 85 may be used as the bevel-finishing tool adjustment unit which adjust a relative positional relationship between the first rotational shafts 22 and the third rotational shaft (a second rotational shaft) 45*b* 1.

The Y-axis driving mechanism 90 includes a driving source (a motor) 91. A shaft 92 which extends in the Y-axis direction is directly connected to a rotational shaft of the motor 91. An encoder which detects a movement position of the spindle holding unit 30 in the Y-axis direction is attached to the motor 91. A screw groove is formed on an outer periphery of the shaft 92. A movement member (for example, a nut) 94 as a bearing is fit to the tip of the shaft 92. The movement support base 31 is fixed to the movement member 94. When the motor 91 is rotationally driven, the movement support base 31 moves along the shaft extending in the Y-axis direction. Accordingly, the spindle holding unit 30 linearly moves in the Y-axis direction. A spring (not shown) is installed in the movement support base 31 so as to cancel a downward load of the movement support base 31, thereby facilitating the movements thereof In a configuration of the processing unit described above, the Y-axis driving mechanism 90 and the Z-axis driving mechanism 85 configure the movement mechanism which changes the relative positional relationship of the first rotational shafts 22 with respect to the rotational shafts (40*a*1, 40*b*1, 40*c*1, 45*a*1, 45*b*1, and 45*c*1). Moreover, as the movement mechanisms thereof, the Y-axis driving mechanism 90 and the Z-axis driving mechanism 85 configure a mechanism which changes a shaft-to-shaft distance between each of the rotational shafts and the first rotational shafts 22, and configure a mechanism which moves the first rotational shafts 22 in the axis direction of the first rotational shafts 22.

<Lens Shape Measurement Unit>

In FIG. 2, above the carriage 21, there are provided a lens shape measurement unit (hereinafter, abbreviated to a measurement unit) 50 and a driving mechanism 55 of the measurement unit. A measurement unit 50F detects a position of the lens front surface (a position of the front surface side of a lens on the target shape). A measurement unit 50R detects a position of the lens rear surface (a position of the rear surface side of a lens on the target shape).

Tracing styli 51F and 51R are respectively fixed to tip end portions of the measurement units 50F and 50R. The tracing stylus 51F comes into contact with the front surface of the lens LE. The tracing stylus 51R comes into contact with the rear surface of the lens LE. The measurement units 50F and 50R are held to be slidable in the Z-axis direction.

The driving mechanism 55 is used to move the measurement units 50F and 50R in the Z-axis direction. For example, rotational driving of a motor (not shown) in the driving mechanism 55 is transmitted to the measurement units 50F and 50R via the rotation transmission mechanism such as a gear. Accordingly, the tracing styli 51F and 51R located in retraction positions move toward the lens LE side, and measuring pressure is applied so as to cause the tracing styli 51F and 51R to be pressed against the lens LE. The configuration of pressing the tracing styli 51F and 51R is not limited thereto. For example, a configuration in which the tracing styli 51F and 51R are pressed by using a spring can be exemplified.

When detecting the position of the front surface of the lens LE, after the lens chuck shafts 22F and 22R are positioned in the Z-axis direction by the shaft angle change mechanism 25, the spindle holding unit 30 moves in the Y-axis direction while the lens LE rotates based on the target shape, and thus, the position of the lens front surface in a lens chuck shaft direction (a position of the front surface side of a lens on the target shape) is detected by an encoder (not shown) which is provided in the measurement unit 50F. Regarding the lens rear surface as well, similar to the case of detecting the position of the lens front surface, the position of the rear surface in the lens chuck shaft direction is detected by an encoder (not shown) which is provided in the measurement unit 50F.

When measuring a lens edge position, initially, the lens chuck shafts 22F and 22R are positioned in the Z-axis direction by the shaft angle change mechanism 25. Thereafter, the tracing stylus 51F comes into contact with the lens front surface, and the tracing stylus 51R comes into contact with the lens rear surface. In this state, the spindle holding unit 30 moves in the Y-axis direction based on target shape data of the lens, and the lens LE rotates. Then, the edge positions (positions in the lens chuck shaft direction) of the lens front surface and the lens rear surface for performing the lens processing are simultaneously measured. The tracing stylus 51F and the tracing stylus 51R may be configured to be integrally movable in the Z-axis direction. In this case, in an edge position measurement portion, the lens front surface and the lens rear surface are individually measured. In the lens shape measurement units 50F and 50R, although the lens chuck shafts 22F and 22R are caused to move in the Y-axis direction, on the contrary, it is possible to have a mechanism in which the tracing stylus 51F and the tracing stylus 51R move relatively in the Y-axis direction.

<Control Portion>

Figure 6:
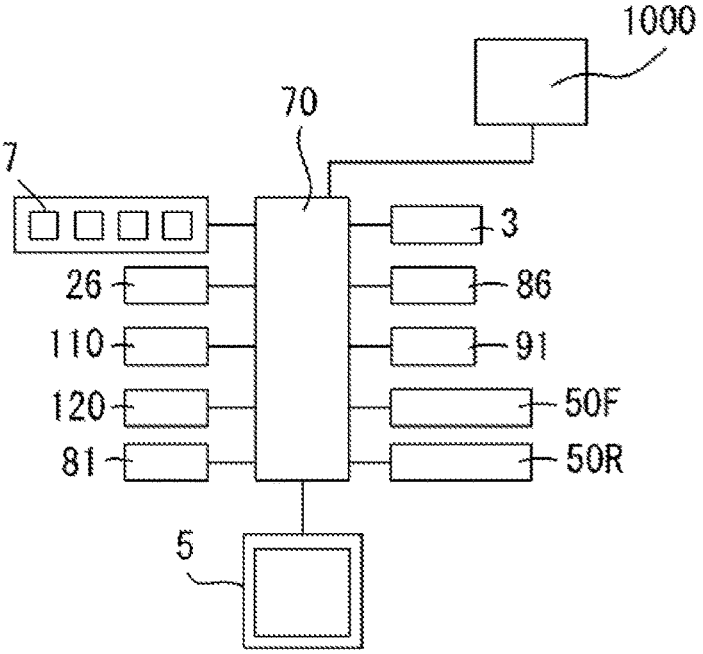
FIG. 6 is a control block diagram of the eyeglass lens processing apparatus.

FIG. 6 is a control block diagram of the eyeglass lens processing apparatus. The motor 26, the motor 110, the motor 120, the motor 81, the motor 86, the motor 91, the motors (not shown) arranged inside each of the spindles, the pressure driving source (not shown), and the lens shape measurement units 50F and 50R are connected to a control portion 70.

A display 5 having a touch panel function to input data of processing conditions, a switch portion 7 provided with a processing start switch and the like, a memory 3, a host computer 1000, and the like are connected to the control portion 70. The host computer 1000 functions as a data inputting unit which inputs data of the processing conditions such as target shape data of the lens, and layout data of an optical center of the eyeglass lens with respect to the target lens shape, necessary to perform processing of a lens.

The control portion 70 controls the driving of the above-described X-axis, Y-axis, and Z-axis driving mechanisms which function as the adjustment unit configured to adjust the relative positional relationship between the first rotational shafts 22 and the second rotational shaft (the third rotational shaft) 45*b*1.

Figure 7:
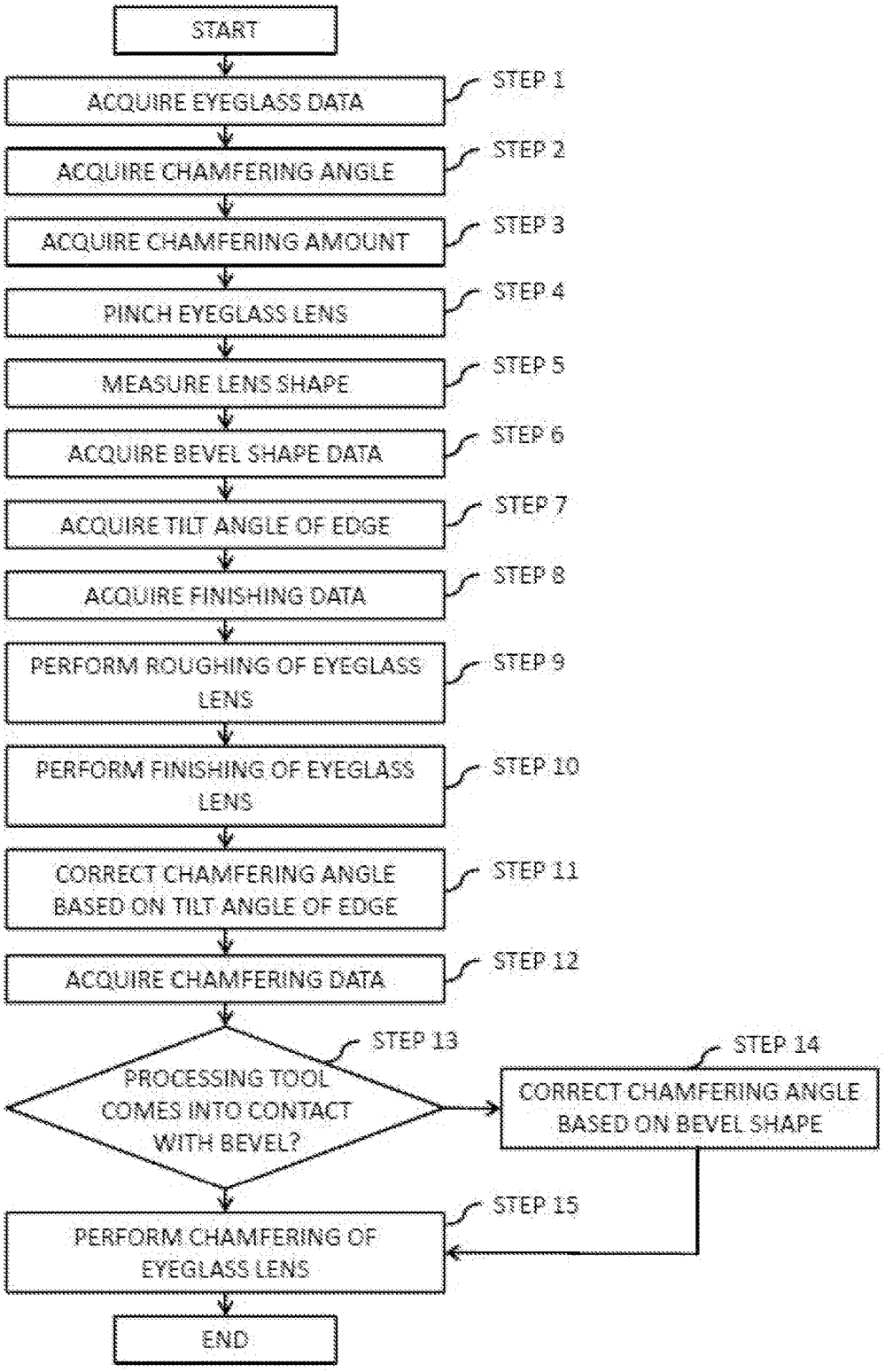
FIG. 7 shows a control flow chart of the eyeglass lens processing apparatus at the time of processing an eyeglass lens.

Hereinafter, a description will be given regarding operations at the tune the eyeglass lens processing apparatus according to the present embodiment performs the roughing, the finishing, and the chamfering. In the following description, the finishing will be described as the beveling or the plano-processing. The control portion 70 includes a processor (for example, a CPU) which manages various types of control processing, and a storage medium which stores an eyeglass lens processing program. In accordance with the eyeglass lens processing program, the processor executes the processing described below based on the control flow chart shown in FIG. 7.

An operator uses an input portion to input eyeglass data regarding eyeglasses to be produced. The eyeglass data includes, for example, the target shape data of the eyeglass frame, the layout data indicating a positional relationship between a geometric center of an eyeglass frame and the optical center of the lens LE, and astigmatic shaft angle data. The operator may import eyeglass data which has been measured in advance from the outside and make a selection therefrom. The control portion 70 acquires and reads the eyeglass data which is input by the operator (Step 1).

Next, the operator uses the input portion (for example, the display 5, the switch portion 7, and the host computer 1000) to select either the beveling or the plano-processing. In the following description, a case of the beveling will be described. However, the plano-processing can be described in the same manner as well.

Figure 8A:
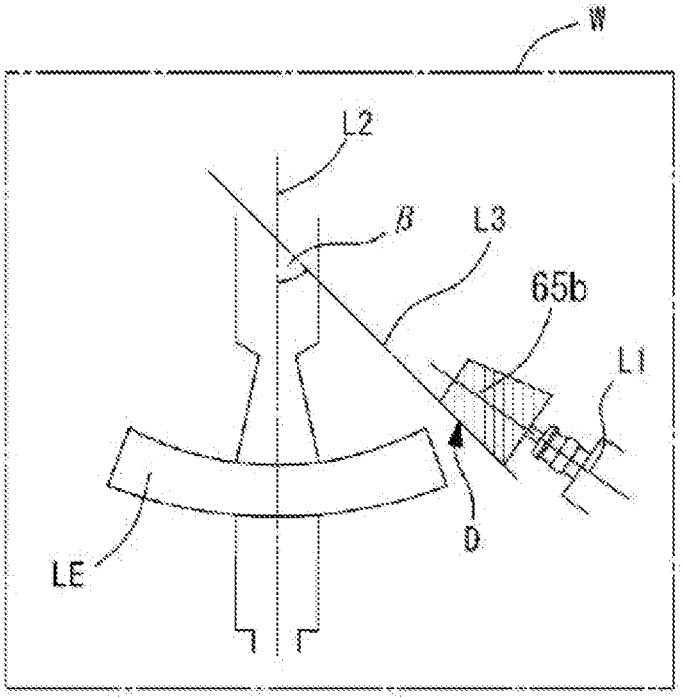
FIGS. 8A and 8B are diagrams showing chamfering angles.
Figure 8B:
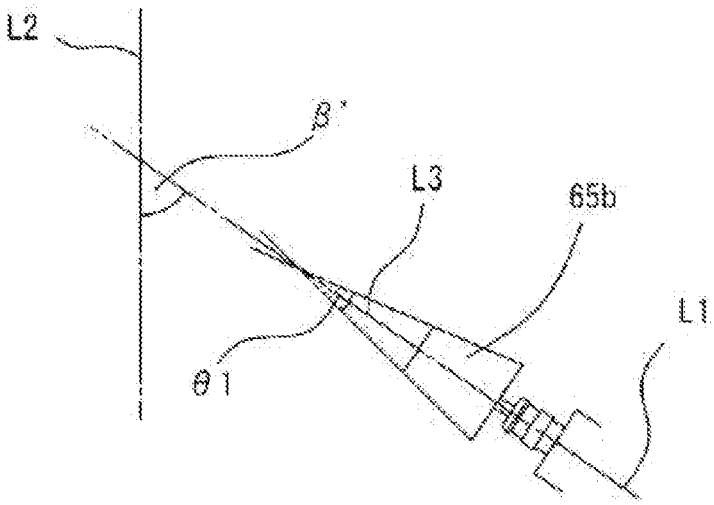

The operator uses the input portion to input a chamfering angle at the time of the chamfering of the lens LE. FIGS. 8A and 8B are diagrams showing the chamfering angles in the present embodiment. FIG. 8A is a cross-sectional view of the processing tool 65*b* on a surface W including a rotational shaft L1 of the second rotational shaft 45*b*1 and the rotational center axis L2 of the first rotational shaft. In the cross-sectional shape of the processing tool 65*b* shown in FIG. 8A, a cutting surface (the processing tool surface) close to the center axis L2 is referred to as a side D. A chamfering angle β in the present embodiment is considered to be an angle formed between an extended line L3 of the side D and the center axis L2. In other words, the chamfering angle β can be referred to as an angle formed between the center axis L2 of the first rotational shaft and the processing tool surface of the chamfering tool when performing the chamfering.

However, the chamfering angle is not limited to this definition as long as a relative relationship of a tilt between the eyeglass lens LE and the processing tool 65*b* can be defined. For example, as shown in FIG. 8B, the chamfering angle may be defined as an angle β' formed between the rotational shaft L1 and the center axis L2. In this case, the relative relationship of a tilt between the lens LE and the processing tool 65*b* can be identified through the half of a tapered angle θ1 of the processing tool and the angle β' which are stored in the memory 3. The tapered angle θ1 indicates an angle of the apex of a cone estimated from the shape of the processing tool.

Figure 9A:
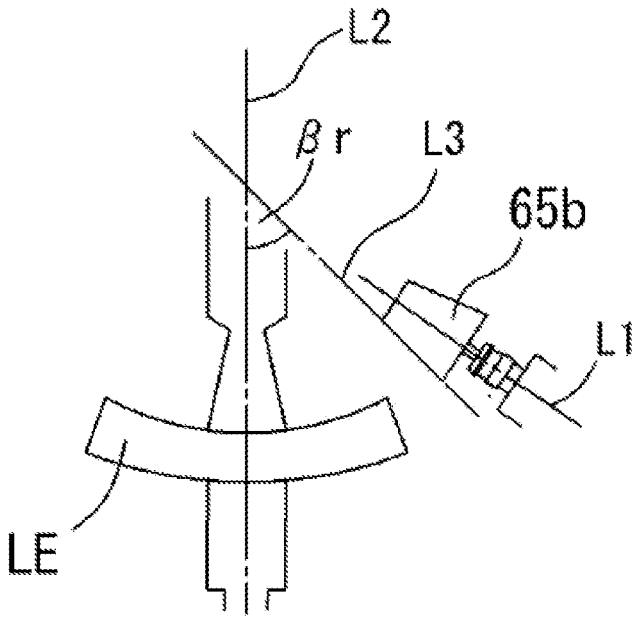
FIGS. 9A and 9B are diagrams showing chamfering angles.
Figure 9B:
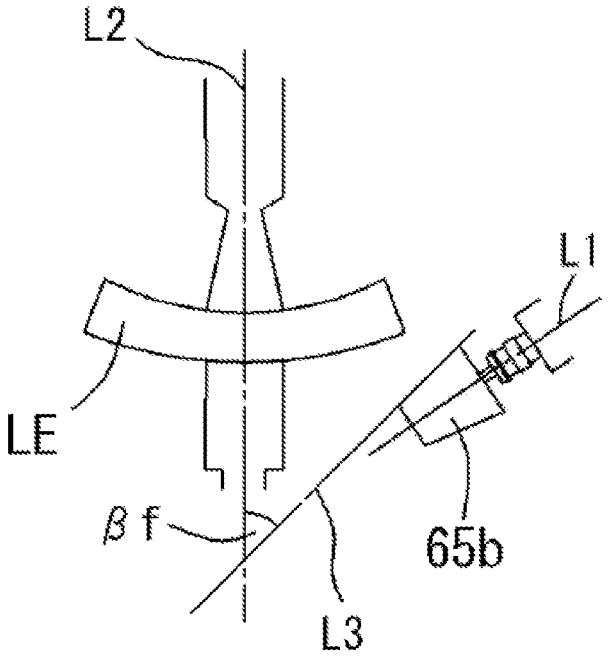

As a method of setting the chamfering angle β, an operator may input arbitrarily the chamfering angle β or may select one chamfering angle β from a plurality of choices. Regarding the chamfering angle β, as shown in FIGS. 9A and 9B, for example, a chamfering angle βr (refer to FIG. 9A) of the lens rear surface and a chamfering angle βf (refer to FIG. 9B) of the lens front surface may be set individually. Naturally, the chamfering angle βr and the chamfering angle βf may be the same angles with each other, or may be the angles different from each other. For example, the operator inputs the chamfering angle β to set the chamfering angle β to the control portion 70 (Step 2).

The control portion 70 may automatically read out the chamfering angle β which is stored in the memory 3 in advance.

As described above, the input portion (for example, the host PC 1000), the control portion 70, and the like function as a chamfering angle setting portion which set the chamfering angle.

Figure 10:
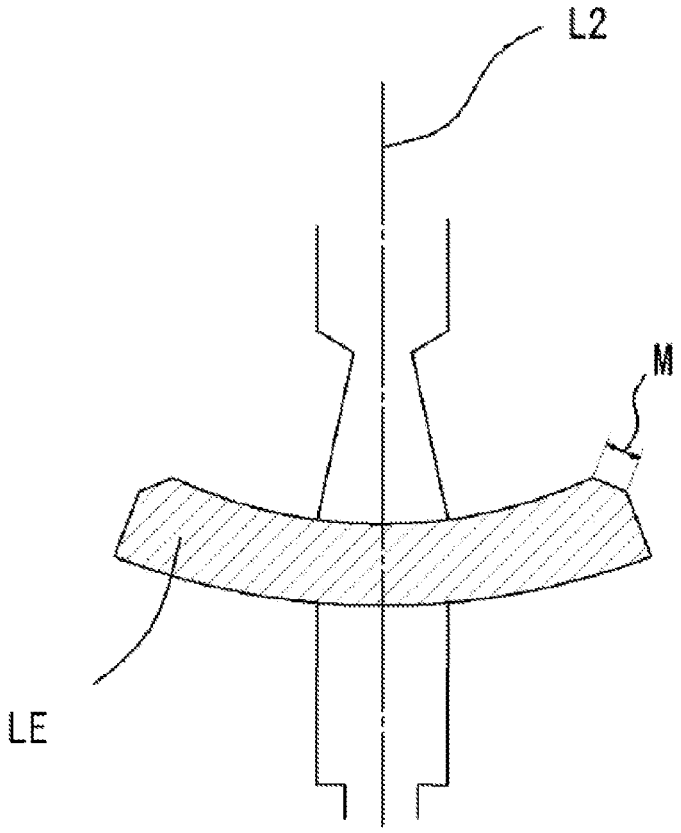
FIG. 10 is a diagram showing a chamfering amount.

Subsequently, an operator inputs a chamfering amount for the chamfering. The operator may arbitrarily input the chamfering amount, or may select one chamfering amount from a plurality of choices. The control portion 70, for example, acquires the chamfering amount input by the operator based on an input signal from the input portion (Step 3). As shown in FIG. 10, in the present embodiment, a chamfering amount M can be described as a length of a processed surface of the lens LE after the chamfering.

The lens LE is set on the first rotational shaft 22F by the operator or a lens transportation unit (not shown). When the lens LE is set, the control portion 70 controls the pressure driving source and moves the holding arm 29 and the first rotational shaft 22R together with the chuck table 23 to make a parallel movement toward the first rotational shaft 22F. Then, the eyeglass lens LE is held by the first rotational shaft 22F and the first rotational shaft 22R (Step 4).

Figure 11A:
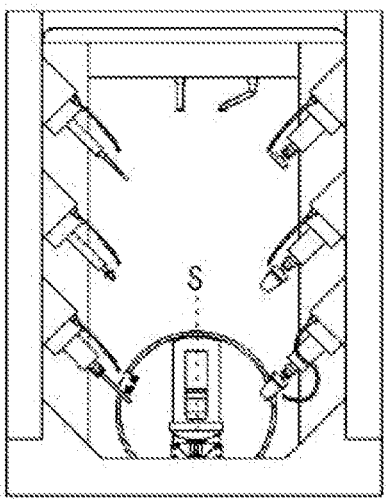
FIGS. 11A to 11D are diagrams showing driving operations of an eyeglass lens processing apparatus 1 at the time of processing the eyeglass lens.
Figure 11B:
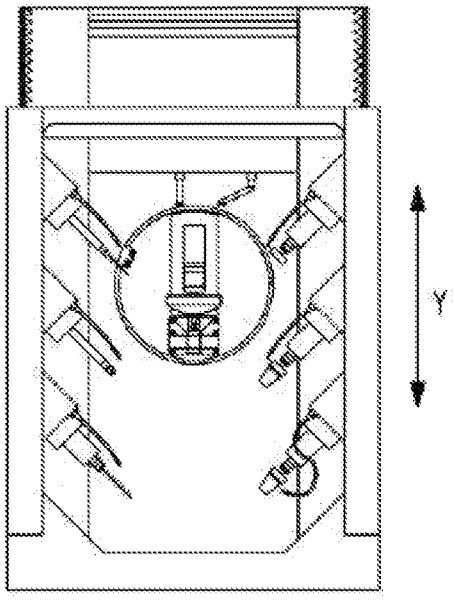

FIGS. 11A to 11D are diagrams showing driving operations of the eyeglass lens processing apparatus 1 at the time of processing of the eyeglass lens. FIG. 11A is a diagram showing a positional relationship (an initial position) of the eyeglass lens processing apparatus 1 before and after starting the processing at the time the eyeglass lens is installed or taken out. The reference sign S (dotted line) indicates the initial position of the first rotational shafts 22 at the time the processing starts. The initial position in the Y-axis direction is the uppermost end position within a driving range in the Y-axis direction. The initial position in the Z-axis direction is an intermediate position within the driving range in the Z-axis direction. The initial position in the X-axis direction is the forefront position within the driving range in the X-axis direction. The initial positions are not limited to the above-described configurations. Any initial position may be acceptable as long as the position is within the driving range of the processing apparatus 1. Naturally, the initial position may be configured to be arbitrarily set by a tester.

When the lens LE is held by the first rotational shafts 22, the control portion 70 drives the motor 81 and retracts the lens chuck unit 20 in the X-axis direction. Then, the control portion 70 drives the motor 91 and moves the spindle holding unit 30 in the Y-axis direction (refer to FIG. 11B). When moving in the Y-axis direction, the control portion 70 rotates the carriage 21 about the axis A by driving the motor 26, thereby changing the shaft angle of the first rotational shafts 22.

Figure 11C:
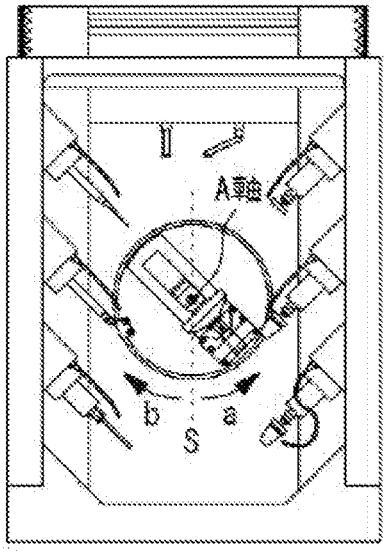
Figure 11D:
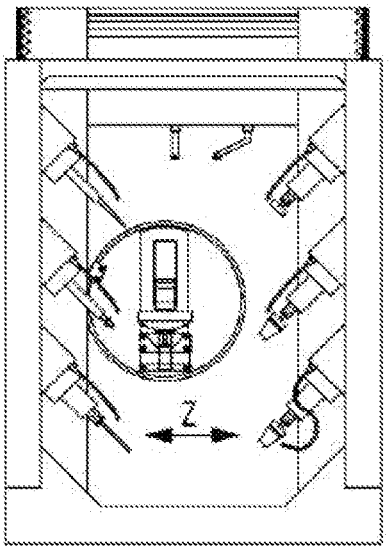

For example, as shown in FIG. 11C, the control portion 70 rotates the first rotational shafts 22 on the axis A as the rotational center from the initial position S in the a direction (the counterclockwise direction) by a predetermined angle. Naturally, the first rotational shafts 22 may be configured to rotate in the b direction (the clockwise direction) by a predetermined angle. The control portion 70 drives the motor 86 to move the first rotational shafts 22 in the Z-axis direction (refer to FIG. 11D).

Figure 12A:
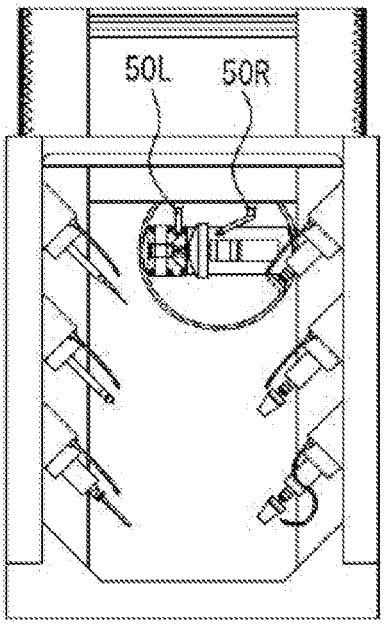
FIGS. 12A to 12C are diagrams showing positional relationships after positional adjustments in the Y-axis and the Z-axis directions, and adjustment of a rotation center shaft.
Figure 12B:
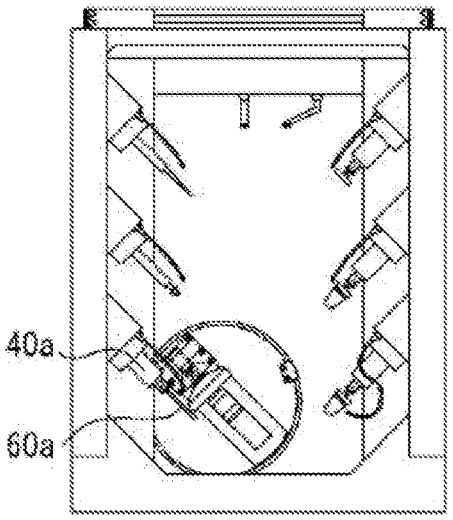
Figure 12C:
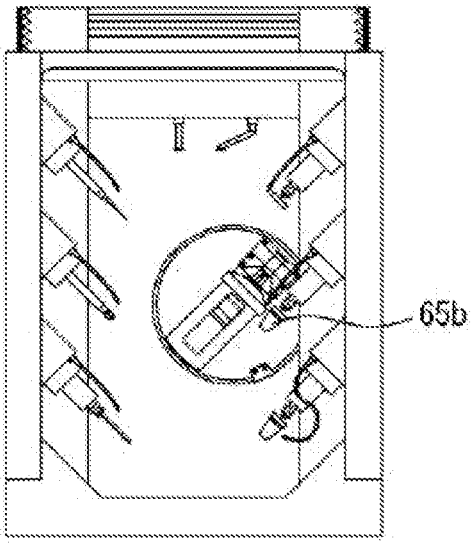

FIGS. 12A to 12C are diagrams showing positional adjustments in the Y-axis and Z-axis directions, and positional relationships after adjusting the first rotational shafts 22. FIG. 12A shows a diagram at the time of detection by the lens shape measurement units 50F and 50R. FIG. 12B shows a diagram at the time the roughing is performed by the processing tool 60*a*, and FIG. 12C shows a diagram at the time the finishing is performed by the finishing tool 65*b*.

Subsequently, the control portion 70 starts to measure a lens shape by using a measurement unit 50 (Step 5). The measurement unit 50 measures the lens shape data of the lens LE based on the target shape data which is acquired by the control portion 70.

The lens shape data, for example, is a three-dimensional position data of the lens front surface or the lens rear surface which is measured along the target shape. In the present embodiment, the measurement unit 50 measures a position of a bevel apex of the lens LE and a position outward by 0.5 mm from the bevel apex position.

Initially, the control portion 70 adjusts the position in the Y-axis and Z-axis directions and adjusts the shaft angle of the first rotational shafts 22 so as to cause the eyeglass lens LE to be placed at the positions of the lens shape measurement units 50F and 50R (refer to FIG. 12A). Then, after adjusting the position in the Y-axis and Z-axis directions and adjusting the shaft angle of the first rotational shafts 22, the control portion 70 drives the motor 81 and moves the lens chuck unit 20 in the X-axis direction. In this manner, when the eyeglass lens LE is positioned at the positions of the measurement units 50F and 50R, the control portion 70 controls the rotational driving of the first rotational shafts 22 and the driving in the Y-axis direction based on the target shape data, thereby acquiring the lens shape data of the lens front surface and the lens rear surface in a rotational center axis direction. The lens shape data measured by the measurement unit 50 is stored in the memory 3.

The method of acquiring the lens shape data is not limited to the above configuration. For example, the tracing stylus 51F of the lens shape measurement unit 50F may be moved linearly outward from the optical center of the target shape, thereby acquiring a curve shape of a lens.

The control portion 70 calculates and acquires the bevel shape data such as the bevel position and a bevel curve value through various computations based on the lens shape data (for example, a thickness of the edge) and the like (Step 6). For example, between the front surface and the rear surface of the lens LE, there may be provided a bevel having a predetermined width to be set. The control portion 70 may automatically calculate the bevel shape data based on the setting. However, the bevel shape data may be input manually by an operator using the input portion. Similarly, the width and the height of the bevel may be automatically set by the control portion 70, or may be input by an operator. An angle of the bevel apex is determined by an angle of a processing groove of the processing tool 65*b*.

After measuring of the lens shape data is completed, the control portion 70 acquires a tilt angle of the edge with respect to the rotational center axis at the time of the finishing of the lens LE (Step 7). According to the processing method described in the present embodiment, the tilt angle of the edge for each vector angle is different from each other, thereby being not constant. Therefore, the control portion 70 acquires the tilt angle of the edge with respect to a position for each of the vector angles of the target shape data. The positions for each of the vector angles are not limited to the positions which are continuously connected. The positions thereof may be distanced at an interval of a predetermined angle. For example, the positions may be distanced by one degree, i.e. a position at zero degree of the vector angle of the target shape data, a position at one degree, a position at two degrees, and so on. Naturally, the predetermined angle is not limited to one degree. The angle may be 0.36 degrees or 0.18 degrees.

The measurement unit 50 or the control portion 70 may be set as an edge information acquisition portion which acquires information regarding the shape of an edge surface such as the tilt angle of the edge surface of the lens LE or the thickness of the edge. In other words, the lens shape measurement unit (for example, the measurement unit 50) may be used as a sensor which acquires the information regarding the shape of the edge surface by measuring the shape of the eyeglass lens using a tracing stylus. The control portion 70 may acquire the information regarding the shape of the edge surface based on a detection signal from the sensor. The control portion 70 may correct the chamfering angle based on the acquired information regarding the shape of the edge surface.

The measurement unit 50 may acquire curve information of the lens front surface when measuring the shape of the eyeglass lens.

In the following description, a description will be given regarding a method of changing the tilt angle of the edge in a base portion of the bevel (a bevel foot) which is formed in a lens in accordance with a vector length of the target shape when the bevel-finishing is performed on the lens edge by the processing tool 65*b*.

The control portion 70, for example, may set the tilt angle of the edge for beveling for each vector angle based on the acquired curve information of the lens front surface and the target shape data. The tilt angle of the edge for beveling denotes the tilt angle of the edge surface to perform the bevel-finishing.

When performing the bevel-finishing, the control portion 70 may perform the beveling of a lens by controlling the X-axis, Y-axis, and Z-axis driving mechanisms or the shaft angle change mechanism 25 based on the target shape data, and the tilt angle of the edge for beveling of each vector angle. The control portion 70 may acquire the tilt angle of the edge for beveling for each vector angle as the tilt angle of the edge surface at the time of the chamfering.

Hereinafter, an example thereof will be described. For example, the tilt angle of the edge is set in a normal direction at a position corresponding to the target shape of the lens front surface. When the tilt angle of the edge is set in the normal direction, particularly, in a case of a highly curved lens (a lens of five curves or more by a curve value on a lens surface) which is framed in a highly curved frame, there are advantages described below.

For example, in contrast to a case where processing is performed to cause the tilt angle of the edge of the bevel to be parallel to the first rotational shafts 22, the situation of decreasing of the bevel is moderated. Since central directions on a front tilt surface and a rear tilt surface of the bevel trace the curve on the lens surface, the bevel is easily accommodated to the highly curved frame (rim), and thus, a lens is stably held in the frame.

The tilt angle of the edge in the base portion of the bevel does not need to strictly match the normal direction at the position corresponding to the target shape. The tilt angle of the edge may be deviated from the normal direction by a certain tolerance angle (for example, three degrees).

The tilt angle of the edge is not limited to the normal direction. The tilt angle of the edge may be arbitrarily input by an operator using the input portion. The tilt angle of the edge may be uniform with each other in each vector angle of the target shape, or may be different from each other in each vector angle of the target shape. The tilt angle of the edge can be set by various methods.

Hereinafter, a description will be given regarding an example of a method of calculating a normal direction when the tilt angle of the edge is caused to match the normal direction at the position corresponding to the target shape of the lens front surface.

The control portion 70 acquires the curve information of the lens front surface in order to calculate the normal direction of the lens front surface. The curve information of the lens front surface can be regarded as being approximately a spherical surface. The control portion 70 obtains coordinates of a center O of a sphere estimated from the spherical surface of the lens front surface. As a front surface curve acquisition portion which acquires the curve information of the lens front surface, for example, the lens shape measurement unit 50 is concurrently used. When there is the curve information of the lens front surface in advance as the eyeglass data, that can be input through the display 5, the host computer 1000, and the like which are examples of the data input portion.

Figure 13:
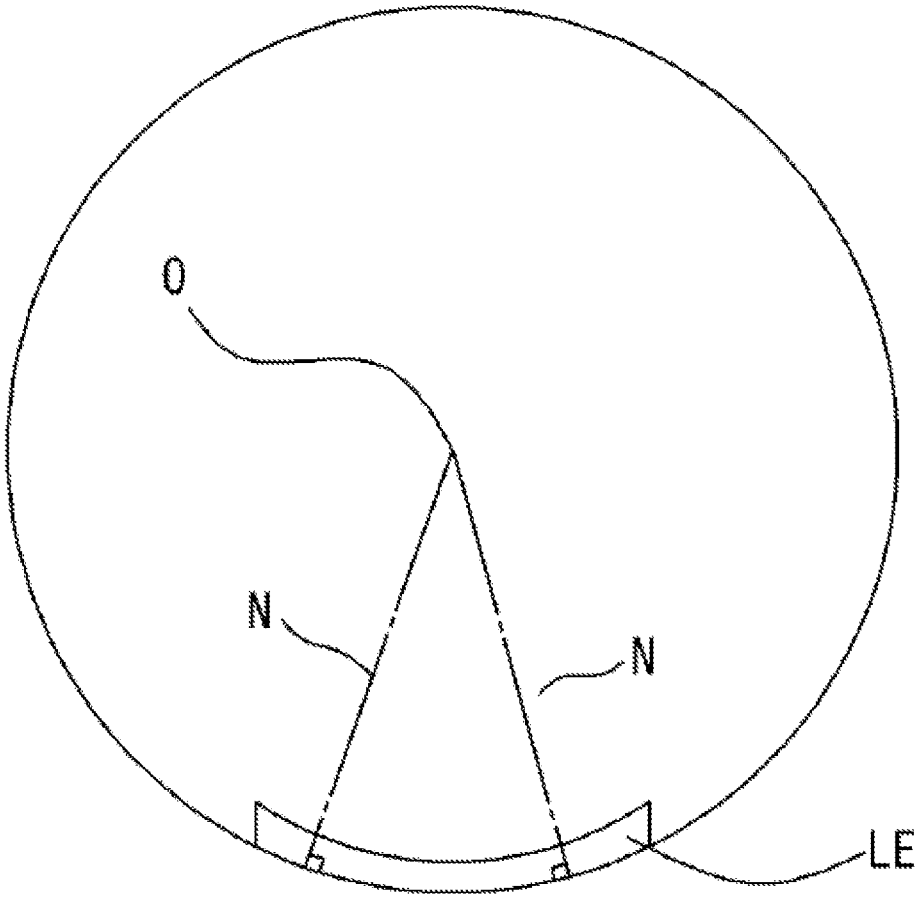
FIG. 13 is a diagram showing a sphere which forms a spherical surface on a lens front surface.

FIG. 13 is a diagram showing a sphere which forms the spherical surface on the lens front surface. In order to obtain the coordinates of the center O of the sphere, the control portion 70, for example, acquires three-dimensional positional data of the lens front surface on at least four points out of the lens shape data measured by the lens shape measurement unit 50. When at least four points are fixed, the sphere formed by the front surface of the lens LE is fixed in one sphere. However, it is exceptional when the selected four points are on a plane surface since the sphere is not fixed in one sphere. In this case, the sphere can be fixed in one sphere by newly selecting another point which is not on the plane surface where the selected four points are included.

When the sphere forming the front surface of the lens LE is fixed in one sphere, the control portion 70 obtains the coordinates of the center O of the sphere from the coordinates of the selected four points and an equation of the sphere. For example, the following is an equation of the sphere in which the center coordinates are Q (s, t, u) and the radius is r.

$$(x-s)^2+(y-t)^2+(z-u)^2=r^2 \quad \text{[Expression 1]}$$

The center coordinates and the radius can be obtained by solving simultaneous equations by substituting the coordinates of four measured points for the above equation.

A linear line passing the center O of the sphere is a normal line at the position corresponding to the target shape of the lens front surface. The control portion 70 obtains a normal line N of the lens front surface passing the center O of the sphere and the position of the bevel apex acquired from the target shape. Then, the finishing is performed by the beveling tool 65*b* so as to cause the direction of the obtained normal line N to match the tilt direction of the edge surface. Hereinafter, with reference to FIG. 14, a description will be given regarding a method of setting the tilt angle of the edge surface at the time of performing the finishing.

Figure 14:
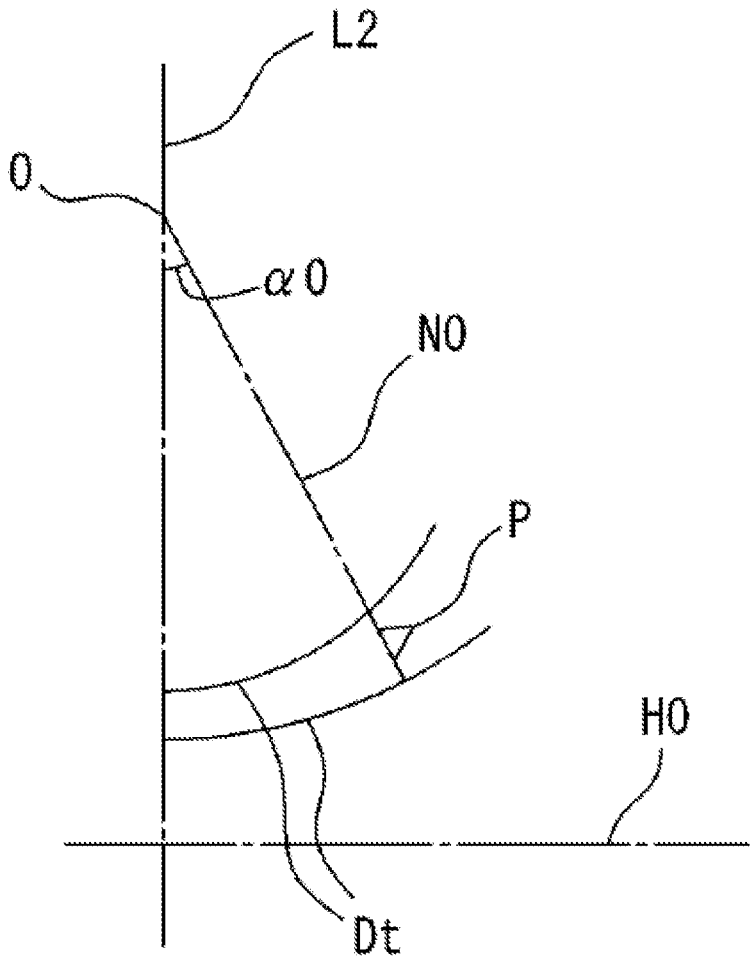
FIG. 14 is a diagram showing lens shape data at a vector angle of 0 degree.

FIG. 14 is a diagram showing lens shape data at the vector angle of 0 degree. As shown in FIG. 14, for example, lens shape data Dt is the positional data having the center axis L2 of the first rotational shafts 22 and a reference plane H0 as criterion. The control portion 70 sets an angle α0 formed between a normal line N0 of the lens front surface and the center axis L2 on the edge surface after the processing as the tilt angle of the edge surface at the time of performing the finishing.

Similarly, on an arbitrary edge surface after the processing, when an angle formed between the normal line N of the lens front surface and the center axis L2 is an angle αN, each vector angle has the angle αN different from each other. Therefore, the control portion 70 calculates the angle αN for each vector angle, thereby setting the tilt angle of the edge surface.

When the angle αN is obtained for each vector angle, the control portion 70 sets the tilt angle of the edge surface for each vector angle based on the obtained angles αN. Then, the control portion 70 calculates and acquires the finishing data to perform the finishing of the lens LE, based on the tilt angle of the edge surface (Step 8). The finishing data includes finishing shape data, first processing control data, and the like. The finishing shape data indicates a shape of the lens LE formed by the finishing. The finishing shape data is calculated based on the lens shape data Dt, the tilt angle αN of the edge surface, the bevel shape data, and the like. Referring to FIG. 14, for example, the lens shape data Dt and bevel apex data P are stored in the memory 3 as the positional data having the center axis L2 and the reference plane H0 which is perpendicular to the center axis L2 as the criterion. When the tilt angle of the edge is set, the positions of the bevel and the edge are fixed on account of information of the bevel apex data P and a width (or a height) of the bevel. Therefore, the control portion 70 synthesizes the fixed positional data of the bevel and the edge, and the lens shape data Dt, thereby calculating the finishing shape data. The first processing control data is used to control the driving of the center axis L2 and the rotational shaft L1 so as to perform the finishing along the processing shape data. The first processing control data can be calculated from the finishing shape data, the shape data of the processing tool stored in the memory 3, and the like. The control portion 70 obtains the finishing shape data, and obtains the first processing control data from the obtained finishing shape data through computations.

Subsequently, the control portion 70 performs the roughing of a lens (Step 9). To this end, the control portion 70 first obtains roughing data based on the obtained finishing data. The roughing data, for example, includes roughing shape data, the roughing control data, and the like. The roughing data is obtained in various manners depending on methods of the roughing.

As a method of the roughing, for example, it is possible to consider performing of the processing outward from the bevel apex position to be formed through the finishing for a predetermined distance (for example, 1 mm). It is favorable when the roughing is performed so as to cause the tilt angle of the edge after the roughing to match the tilt angle of the edge after the finishing.

The control portion 70, for example, estimates the shape of the lens LE to be formed through the above-described method of the roughing, thereby calculating the roughing shape data. Then, in order to perform the processing of the lens LE along the roughing shape data, the control portion 70 calculates the roughing control data to control the X-axis, Y-axis, and Z-axis driving mechanisms or the shaft angle change mechanism 25.

When the roughing data is obtained, the control portion 70 starts the roughing. The control portion 70 rotates the first rotational shafts 22 by a predetermined angle so as to cause the front surface side of a lens to be oriented toward a proximal portion of each of the processing tools. Then, the control portion 70 controls the X-axis, Y-axis, and Z-axis driving mechanisms or the shaft angle change mechanism 25 to relatively move the first rotational shafts 22 with respect to the rotational shaft 41*a*.

When the roughing is completed, the control portion 70 performs the finishing based on the obtained finishing data (Step 10). The control portion 70 drives the motor 81 so as to retract the lens chuck unit 20 in the X-axis direction. Similar to the above description, the control portion 70 adjusts the position in the Y-axis and Z-axis directions and adjusts the shaft angle of the first rotational shafts 22, thereby causing the eyeglass lens LE to be placed at the position of the processing tool 65*b* to perform the finishing (refer to FIG. 12C). The lens shape may be measured again by the measurement unit 50 to check whether the lens LE is deformed due to heat and the like through the roughing.

The control portion 70 causes the first rotational shafts 22 to tilt so as to tilt with respect to the conical cutting surface of the processing tool 65*b*, in accordance with the tilt angle of the edge (the angle of the lens front surface in the normal direction N) which is calculated for each vector angle. Then, the finishing is performed.

In the beveling, the control portion 70 controls the driving in the Y-axis direction and the Z-axis direction so as to cause a predetermined position of the lens edge after the roughing to be positioned in the bevel groove of the processing tool 65*b*, based on the bevel shape data. The control portion 70 changes the shaft angle of the first rotational shafts 22 in each vector angle and controls the rotational driving of the shaft angle of the first rotational shafts 22 having the axis A as the rotational center so as to cause the edge surface to match the normal direction N of the front surface curve of the lens LE. Accordingly, the shape of the lens LE after the processing matches the finishing shape data. Therefore, the direction of the edge of the finished lens LE matches the normal direction N of the lens front surface.

<Chamfering>

When the finishing of the lens LE is completed, the control portion 70 performs the chamfering. Initially, before performing the chamfering, the control portion 70 corrects the chamfering angle β which is input by an operator in Step 2. As a correction at a first stage, the control portion 70 corrects the chamfering angle β based on the tilt angle of the edge after the finishing (Step 11). The control portion 70 functions as an angle correction portion which corrects the chamfering angle set by the input portion (for example, the host PC 1000) and the chamfering angle setting portion such as the control portion 70, based on the information regarding the shape of the edge surface (for example, the tilt angle of the edge surface with respect to the rotational center axis L2) acquired by the edge information acquisition portion.

An example will be described regarding a method of correcting the chamfering angle β in Step 11 based on the tilt angle of the edge. The description will be given dividing the chamfering angle β into a chamfering angle βr of the lens rear surface and a chamfering angle βf of the lens front surface (refer to FIGS. 9A and 9B). As the correction method thereof, for example, it is possible to consider a method of correcting the chamfering angle β by adding or subtracting a tilt angle α of the edge surface after the finishing with respect to the chamfering angle β. The tilt angle α of the edge surface is set in Step 7.

Figure 15A:
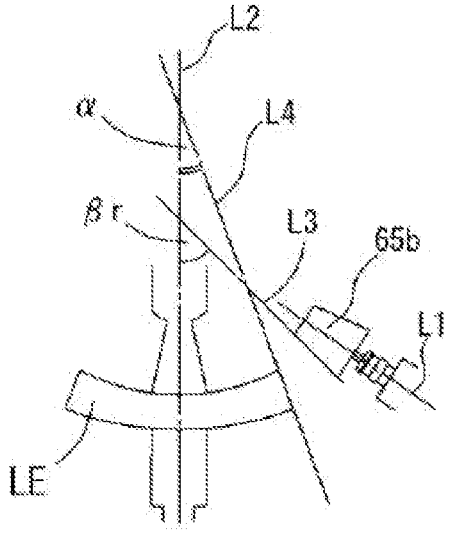
FIGS. 15A and 15B are diagrams showing a method of correcting a chamfering angle βr on a lens rear surface.
Figure 15B:
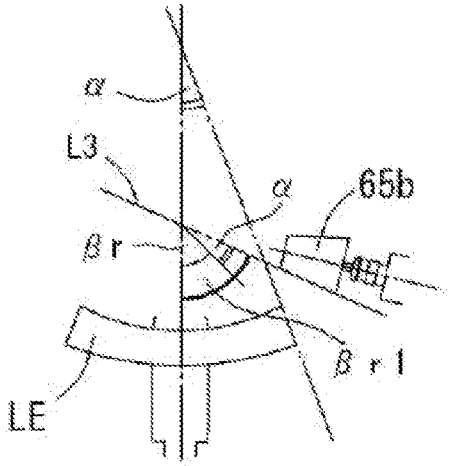

Initially, a description will be given regarding a method of correcting the chamfering angle βr of the lens rear surface. FIGS. 15A and 15B are diagrams showing a method of correcting a chamfering angle βr on the lens rear surface which is set in Step 2. FIG. 15A shows the relationship between the lens LE and the processing tool when the chamfering angle βr is not corrected, and FIG. 15B shows the relationship therebetween when the chamfering angle βr is corrected.

When the chamfering angle is not corrected, as shown in FIG. 15A, the center axis L2 and the cutting surface of the processing tool 65*b* tilt by the chamfering angle βr which is set in Step 2. When the chamfering is performed in this state, if the tilt angle α of the edge surface is large, an angular portion on the lens rear surface may not be completely removed. Therefore, the control portion 70 corrects the chamfering angle βr.

As shown in FIG. 15B, the control portion 70 adds the tilt angle α of the edge surface to the chamfering angle βr which is set in Step 2 and corrects the chamfering angle βr to a chamfering angle βr1. As the tilt angle α of the edge surface is added, the chamfering angle becomes large, and thus, the cutting surface of the processing tool 65*b* comes into contact with the angular portion of the lens LE at a favorable angle.

Figure 16A:
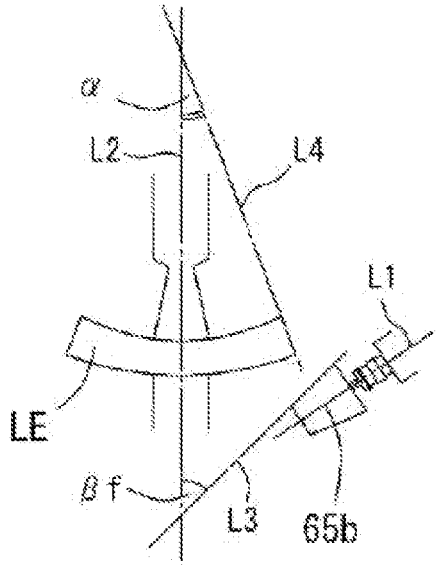
FIGS. 16A and 16B are diagrams showing a method of correcting a chamfering angle βf on the lens front surface.
Figure 16B:
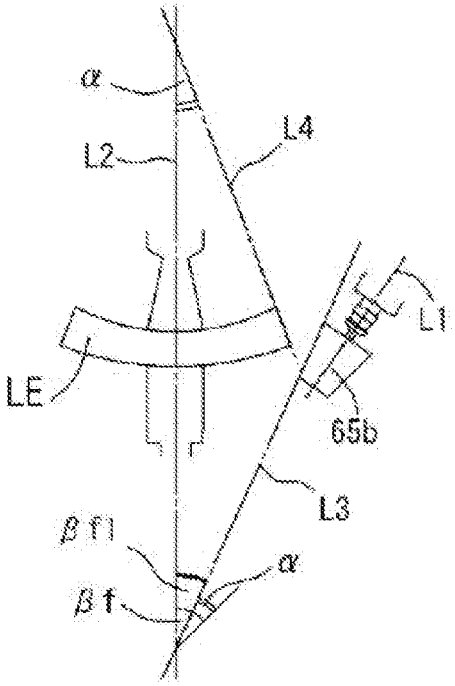

Similarly, an example will be described regarding a method of correcting the chamfering angle βf of the lens front surface. FIG. 16A shows the relationship between the lens LE and the processing tool when the chamfering angle βf is not corrected, and FIG. 16B shows the relationship therebetween when the chamfering angle β f is corrected.

Figure 17:
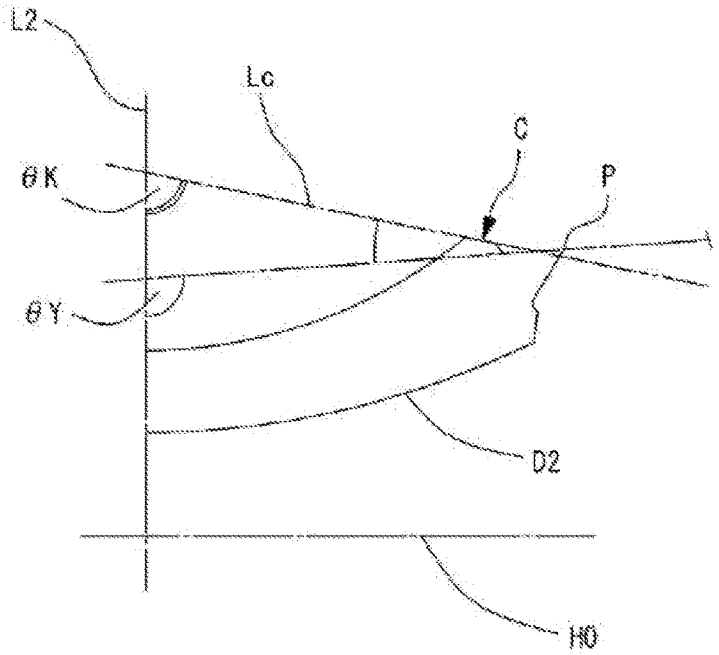
FIG. 17 is a schematic diagram showing chamfering shape data at a certain vector angle.

When the chamfering angle is not corrected, as shown in FIG. 16A, the center axis L2 and the cutting surface of the processing tool 65*b* tilt by the chamfering angle βf which is set in Step 2. Similar to the chamfering of the lens rear surface, there may be a case where favorable chamfering cannot be performed in the chamfering of the lens front surface due to an influence of the tilt angle of the edge surface. Therefore, the control portion 70 corrects the chamfering angle βf As shown in FIG. 17, the control portion 70 subtracts the tilt angle α of the edge surface from the chamfering angle βf set in Step 2, and corrects the chamfering angle βf to a chamfering angle βf1. As the tilt angle α of the edge surface is subtracted, the chamfering angle becomes small, and thus, the cutting surface of the processing tool 65*b* comes into contact with the angular portion of the lens LE at a favorable angle.

As described above, as the control portion 70 corrects the chamfering angles βr and βf, the chamfering angle βf of the lens front surface and the chamfering angle βr of the lens rear surface become the angles different from each other. Therefore, in the present embodiment, the control portion 70 controls the relative position between the first rotational shafts 22 and the second rotational shaft 45*b*1, and the control portion 70 performs the chamfering at respectively different chamfering angles in the lens front surface and the lens rear surface.

When the above-described correction method is used, the corrected chamfering angle becomes an angle different from the chamfering angle β which is set in Step 2. However, the angle at which the cutting surface of the processing tool 65*b* tilts with respect to the lens edge surface matches the chamfering angle β1 which is input in advance by an operator in Step 2.

When the control portion 70 corrects the chamfering angles βr and βf, the control portion 70 calculates and acquires chamfering data based on the corrected chamfering angles βr1 and βf1 and the finishing data (Step 12). The chamfering data includes the chamfering shape data, second processing control data, and the like. The chamfering shape data indicates a shape of the lens LE formed by the chamfering. The chamfering shape data is obtained by changing a portion of the finishing shape data based on the corrected chamfering angles βr and βf, a chamfering amount and the like input in Step 3 (refer to FIG. 17). The second processing control data is used to control the driving of the first rotational shafts 22 and the second rotational shaft 45*b*1 so as to perform the chamfering along the chamfering shape data.

After the chamfering data is calculated, the control portion 70 further determines whether the chamfering tool comes into contact with the bevel when performing the chamfering based on the calculated chamfering data (Step 13). As a determination method, for example, as shown in FIG. 17, the control portion 70 may determine whether the chamfering tool comes into contact with the bevel by determining whether the chamfering shape data of the chamfering tool interferes with the positional data of the bevel formed in the eyeglass lens. For example, regarding the determination whether the chamfering tool interferes with the bevel, the determination is performed based on at least the information of an angle (the tapered angle) of the cutting surface of the chamfering tool. In other words, the information regarding the bevel and the information of the tapered angle of the chamfering tool are compared, and thus, the determination is performed whether the bevel interferes therewith, based on the compared result.

As an example, a method will be given regarding the determination whether the chamfering tool comes into contact with the bevel when performing the chamfering of the lens rear surface. FIG. 17 is a schematic diagram showing the chamfering shape data at a certain vector angle. In chamfering shape data D2, a portion where the chamfering is performed is referred to as a chamfering portion C. Regarding the chamfering portion C, the linear line including the chamfering portion C which is to be indicated in a linear line similar to the cutting surface of the processing tool 65*b* (for example, the tapered angle) is referred to as a linear line Lc. The position of the bevel apex is referred to as a coordinate P.

As the determination method, for example, the determination may be performed through a positional relationship between the linear line Lc and the coordinate P. In a case where the chamfering shape data D2 is in a direction as shown in FIG. 17, for example, when the coordinate P exists above the linear line Lc, the control portion 70 determines that the processing tool 65*b* comes into contact with the bevel. On the contrary, when the coordinate P exists below the linear line Lc, the control portion 70 determines that the processing tool 65*b* does not come into contact with the bevel. When the chamfering shape data D2 is vertically inverted with respect to the case in FIG. 17, the vertical relationship between the coordinates P and the linear line LC is also inverted.

Similarly, the control portion 70 determines whether the chamfering tool 65*b* comes into contact with the bevel throughout the overall periphery at each vector angle of the target shape data.

When the control portion 70 determines that the chamfering tool 65*b* comes into contact with the bevel, a correction is made for the chamfering angle corresponding to the position of the vector angle which is determined to be in contact so as to cause the chamfering tool 65*b* not to come into contact with the bevel (Step 14). In this manner, the bevel can be prevented from being deformed by the chamfering tool 65*b*.

Naturally, the determination method is not limited to the above-described determination unit. For example, when the linear line Lc is overlapped with the coordinate of the bevel portion, the control portion 70 may determine that the processing tool 65*b* comes into contact with the bevel.

Another determination method can be considered. For example, the control portion 70 calculates a path traced by the chamfering tool when performing the chamfering, out of processing tool information such as a length of cutter, a diameter, a tapered angle of the chamfering tool 65*b* stored in the memory 3 in advance as well as the second processing control data. Then, when the bevel shape data based on the finishing data is overlapped with the path of the chamfering tool, the control portion 70 determines that the chamfering tool comes into contact with the bevel.

As still another determination method, for example, as shown in FIG. 17, a tilt angle θK of the linear line Lc with respect to the center axis L2 and a tilt angle θY at which a rear tilt surface of the bevel tilts with respect to the center axis L2 may be compared to each other. The control portion 70 may determine that the processing tool has a possibility of coming into contact with the bevel when the tilt angle θK is smaller than the tilt angle θY In order to determine whether the bevel comes into contact with the chamfering tool, there is a need to acquire a tilt surface angle of the bevel formed in the eyeglass lens with respect to the rotational center axis L2. For this reason, the control portion 70 calculates the tilt surface angle of the bevel with respect to the rotational center axis L2, from the finishing data. In this manner, in the present embodiment, the control portion 70 is used as an edge surface tilt setting portion to acquire the tilt surface angle of the bevel formed in the eyeglass lens with respect to the rotational center axis L1.

A description will be given regarding a method of correcting the chamfering angle such that the processing tool 65*b* does not to come into contact with the bevel, in Step 14. In the present embodiment, the chamfering angles βr1 and βf1 acquired through the correction in Step 11 are further corrected. However, depending on the procedure of the correction, the chamfering angle β which is set in Step 2 may be corrected in Step 14.

As a method of correcting the chamfering angles βr1 and βf1, for example, it is possible to consider the correction causing an angle at which the rear tilt surface (the front tilt surface) of the bevel tilts to have a predetermined relationship with an angle (the chamfering angle) at which the cutting surface of the processing tool 65*b* tilts, with respect to the center axis L2.

Figure 18A:
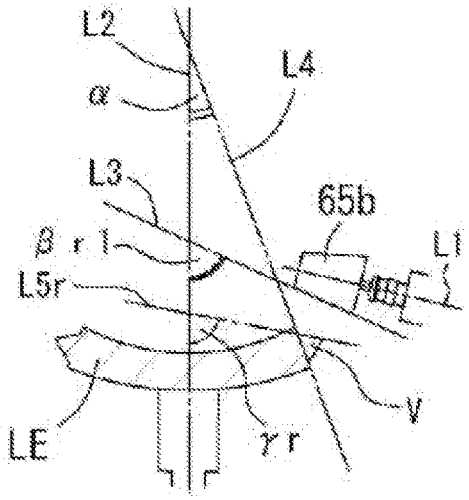
FIGS. 18A and 18B are diagrams showing a method of correcting a chamfering angle on the lens rear surface.

Initially, a description will be given regarding a method of correcting the chamfering angle βr1 of the lens rear surface. FIG. 18A is a diagram showing a relationship between the lens LE and the processing tool in a case where the chamfering angle βr1 is not corrected, and FIG. 18B is a diagram showing a case where the chamfering angle βr1 is corrected, when the processing tool is determined to come into contact with the bevel in Step 13.

When the chamfering angle βr1 is not corrected, as shown in FIG. 18A, the center axis L2 and the cutting surface of the processing tool 65*b* tilt by the chamfering angle βr1 which is corrected in Step 11. When the chamfering is performed in this state, the processing tool 65*b* comes into contact with a bevel V, and thus, there is a possibility of deformation of the bevel. Therefore, the control portion 70 corrects the chamfering angle βr1

Figure 18B:
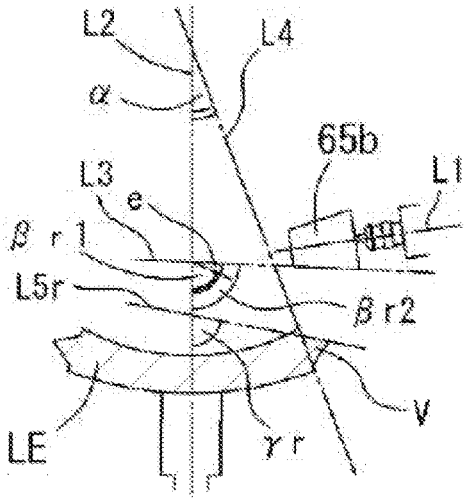

As shown in FIG. 18B, the control portion 70 corrects the chamfering angle βr1 to a chamfering angle βr2 by adding a predetermined angle e to the chamfering angle βr1 which is corrected in Step 11. For example, a predetermined angle e is set to an angle satisfying the condition of the following expression, so that it possible to prevent the processing tool 65*b* from coming into contact with the bevel V.

$$e \geq \gamma r - \beta r1 \quad \text{[Expression 2]}$$

Figure 19A:
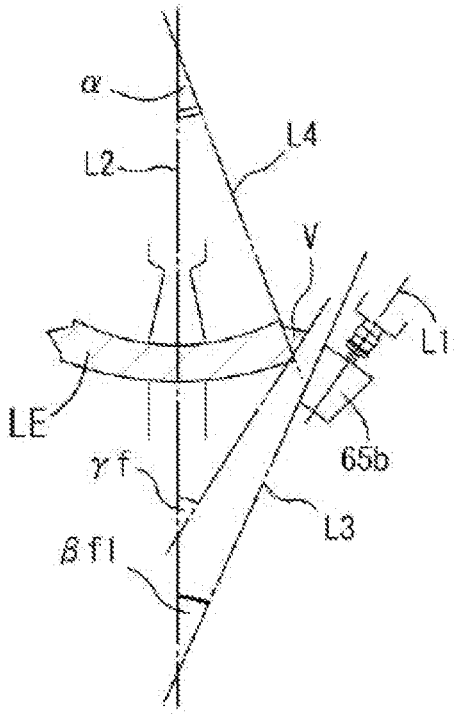
FIGS. 19A and 19B are diagrams showing the method of correcting a chamfering angle on the lens front surface.
Figure 19B:
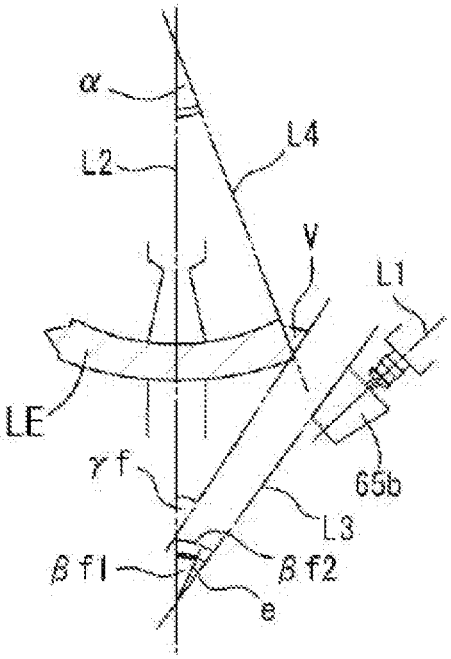

When a predetermined angle e satisfying the above condition is added to βr1, the chamfering angle βr2 becomes larger than a tilt angle γr at which the rear tilt surface of the bevel V tilts with respect to the center axis L2. Accordingly, the processing tool 65*b* is prevented from coming into contact with the bevel V FIG. 19A is a diagram showing a relationship between the lens LE and the processing tool in a case where the chamfering angle βf1 of the lens front surface is not corrected, and FIG. 19B is a diagram showing a case where the chamfering angle βf1 is corrected, when the processing tool is determined to come into contact with the bevel in both cases.

A case of correcting the chamfering angle βf1 of the lens front surface can be described similar to the case of correcting the chamfering angle βr1 of the lens rear surface. In other words, it is favorable that a predetermined angle e is added so as to cause the chamfering angle βf1 to be larger than a tilt angle γf at which the tilt surface of the bevel V tilts with respect to the center axis L2.

Incidentally, when a predetermined angle e is exceedingly large, the chamfering is not favorably performed, and thus, there is a possibility that the angular portion may not be completely eliminated. Therefore, it is preferable to set a predetermined angle e as small as possible. For example, it is preferable that a predetermined angle e be set to cause the corrected chamfering angles βr2 and βf2 to be larger than the tilt angles γr and γf of the tilt surface of the bevel V by 1 to 5 degrees. It is considerable that the processing tool 65*b* comes into contact with the bevel due to a malfunction of an apparatus. Therefore, a predetermined angle e may be set to be sufficient in order to prevent the erroneous contact by causing the chamfering angles βr2 and βf2 to be larger than the tilt angles γr and γf of the tilt surface of the bevel V by 2 to 5 degrees.

When the chamfering angles βr1 and βf1 are corrected to the chamfering angles βr2 and βf2 by the above-described method, the control portion 70, for example, revise the chamfering data based on the corrected amount thereof Meanwhile, when the chamfering tool 65*b* is determined not to come into contact with the bevel, the control portion 70 proceeds to the next step without correcting the chamfering angle corrected in Step 11. In this manner, the control portion 70 functions as the determination unit which determines whether the bevel formed in the lens LE comes into contact with the chamfering tool.

<Controlling During Chamfering>

When the chamfering angle is corrected, the control portion 70 drives the driving mechanism, thereby starting the chamfering. Hereinafter, a controlling operation of the chamfering will be described. The control portion 70 controls the tilt angle of the first rotational shafts 22 based on the chamfering angles βr2 and βf2 (or βr1 and βf1) which are set for each vector angle on the target shape. In other words, the control portion 70 performs the chamfering while controlling the tilt angle of the first rotational shafts 22 through the shaft angle change portion 25 and the like. The control portion 70 rotates the shaft angle of the first rotational shafts 22 in the a direction or the b direction by 180°, thereby switching the front surface and the rear surface of the eyeglass lens on which the processing is performed by using the processing tool 65*b*.

In the present embodiment, the processing tool 65*b* is concurrently used as the processing tool for chamfering. In this case, a flat-finishing surface is concurrently used as a chamfering surface. The control portion 70 drives the driving mechanisms (for example, the X-axis, Y-axis, and Z-axis driving mechanisms, and the shaft angle change portion 25) from the position where the finishing is performed to the position where the chamfering is performed, thereby causing the lens LE to approach the chamfering tool 65*b*. When the lens LE approaches the chamfering tool 65*b* at a predetermined distance, the control portion 70 causes the driving of the driving mechanism to pause. Then, the control portion 70 controls the X-axis, Y-axis, and Z-axis driving mechanisms, and the shaft angle change portion 25 again so as to cause the angle which is formed between the center axis L2 and the cutting surface of the chamfering tool 65*b* to match the chamfering angle βr2 and βf2 (or βr1 and βf1) which are corrected in Steps 11 or 14. In other words, the control portion 70 performs the chamfering by performing the controlling in the Y-axis direction and the Z-axis direction based on the second processing control data.

When the angle which is formed between the center axis L2 and the cutting surface of the chamfering tool 65*b* matches the corrected chamfering angles βr2 and βf2 (or βr1 and βf1, the control portion 70 drives the second rotational shaft 45*b*1 to rotate the processing tool 65*b*. Then, in a state where the angle formed between the center axis L2 and the cutting surface of the chamfering tool 65*b* matches the corrected chamfering angles βr2 and βf2 (or βr1 and βf1, the driving mechanism is controlled, and the first rotational shafts 22 is caused to relatively approach the second rotational shaft 45*b*1, thereby performing the chamfering (Step 15). Then, the control portion 70 performs the chamfering of the lens rim by rotating the first rotational shafts 22. Simultaneously, the shaft angle is changed by the shaft angle change mechanism 25, thereby causing the angle formed between the center axis L2 and the cutting surface of the chamfering tool 65*b* to match the corrected chamfering angles βr2 and βf2 (or βr1 and βf1). In other words, the control portion 70 performs the chamfering while changing the chamfering angles for a position of each vector angle of the target shape data.

For example, in the present embodiment, the chamfering angle β which is set by the input portion (for example, the display 5, the switch portion 7, the host computer 1000, and the control portion 70) is corrected by the angle correction portion such as the control portion 70. The driving of the adjustment unit such as the X-axis, Y-axis, and Z-axis driving mechanisms, or the shaft angle change portion 25 is controlled by the control portion 70 based on the corrected chamfering angles (the chamfering angles βr1 and βr2, and βf1 and βf2). Thus, the relative positional relationship between the first rotational shaft and the second rotational shaft is adjusted, thereby performing the chamfering.

In this manner, even though the axis direction of the first rotational shafts 22 does not match the direction of the finished edge surface of the lens LE, it is possible to cause the chamfering tool to abut on the angular portion of the edge of the lens LE at an appropriate angle by correcting the chamfering angle. Therefore, it is possible to perform the favorable chamfering so as to moderate the sharpness of the angular portion which is formed between an optical surface of the lens LE and the edge surface.

For example, when performing the chamfering of the lens front surface on the so-called highly curved lens having a large curvature, compared to a case of the processing performed at the same the chamfering angle as the general low curved lens, the cutting surface of the processing tool comes into contact with the optical surface (refractive surface) of a lens at a shallow (small) angle. In this case, the chamfering amount greatly varies due to a slight malfunction of an apparatus. Therefore, as in the present embodiment, the processing tool can be prevented from coming into contact with the lens optical surface at a shallow (small) angle, by correcting the chamfering angle.

As in the present embodiment, instead of performing the chamfering collectively in the chamfering angles, it is possible to perform the chamfering suitable for any position in the lens rim by allowing the chamfering angle to be changeable for each vector angle of the target shape data or each position of the target shape data.

Naturally, the chamfering angles may be collectively (uniformly) obtained. For example, when correcting the chamfering angle in Step 11, the chamfering angle may be corrected using an average value of the tilt angle of the edge surface which is obtained for each vector angle of the target shape data or for each point of the target shape data.

In this case, for example, the chamfering is performed throughout the overall periphery of the target shape data using the collectively (uniformly) obtained chamfering angle which is obtained by adding or subtracting the average value of the tilt angles of the edge surface with respect to the chamfering angle which is input by an operator. In this manner, when the chamfering angle is corrected by the control portion 70 so as to be collectively (uniformly) obtained throughout the overall periphery of the target shape data, the driving of the rotational center axis L2 or the second rotational shaft is easily controlled when performing the chamfering.

Incidentally, the chamfering angle may be corrected by using not only the average value of the tilt angles of the edge surface as described above but also using the maximum value or the minimum value of the tilt angle on the edge surface.

In the present embodiment, a case of performing the beveling in the lens LE is described. However, other processing such as the plano-processing can be similarly described. For example, in a case of the plano-processing, the bevel is not formed on the lens edge surface. Therefore, in Step 13, the control portion 70 determines that the cutting surface of the processing tool does not come into contact with the bevel, thereby proceeding to Step 15 of the chamfering.

In this manner, the chamfering angle is corrected through two stages of the step, and thus, it is possible to correct the chamfering angle being associated with various processing such as the beveling or the plano-processing.

In the above description, the chamfering angle is corrected based on the tilt angle of the edge surface with respect to the rotational center axis L2 in Step 11. Thereafter, the chamfering angle is corrected again based on the bevel shape in Step 14. However, the procedure is not limited thereto.

For example, initially, as the first stage of the step, the control portion 70 determines whether the tilt angle at which the cutting surface of the processing tool tilts is larger or smaller than the tilt angle of the bevel with respect to the rotational center axis L2 based on the finishing data, thereby correcting the chamfering angle. When correcting the chamfering angle of the lens rear surface, for example, the chamfering angle is corrected so as to cause the tilt at which the cutting surface of the processing tool tilts to be smaller than the tilt angle of the bevel with respect to the rotational center axis L2. When correcting the chamfering angle of the lens front surface, for example, the chamfering angle is corrected so as to cause the tilt at which the cutting surface of the processing tool tilts to be larger than the tilt angle of the bevel with respect to the rotational center axis L2.

Thereafter, as the second stage of the step, the control portion 70 may further correct the chamfering angle based on the tilt angle of the edge surface. As described above, instead of correcting the chamfering angle through two stages of the step, the chamfering angle may be corrected through only one stage of step.

Without being limited to the above methods, when performing the chamfering, it is preferable that the chamfering angle be corrected to more suitable angle by the angle correction portion such as the control portion 70.

In the present embodiment, the control portion 70 corrects the chamfering angle at all times based on the tilt angle of the edge. However, this is not limited thereto. For example, the control portion 70 may correct the chamfering angle when the tilt angle of the edge surface with respect to the rotational center axis L2 exceeds a predetermined angle. In other words, when the tilt angle of the edge surface with respect to the rotational center axis L2 is smaller than a predetermined angle, the control portion 70 may perform the chamfering of a lens at the chamfering angle acquired by an input of the input portion, without correcting the chamfering angle.

In the above description, when the chamfering tool is determined to come into contact with the bevel, the control portion 70 corrects the chamfering angle. However, this is not limited thereto.

For example, when the chamfering angle input by a chamfering angle input portion (for example, the host PC 1000) is smaller than the tilt angle of the bevel, a signal may be output by a signal output portion and the like in order to notify an operator of the possibility that the chamfering tool may come into contact with the bevel. Alternatively, the driving of the apparatus may be controlled by transmitting a signal to the driving mechanism. For example, the driving of the apparatus may be stopped before the chamfering starts.

Accordingly, an operator can know that the chamfering tool comes into contact with the bevel at the input chamfering angle.

In the above description, the finishing is performed by causing the edge surface to tilt with respect to the center axis L2. However, this is not limited thereto. Even when the edge surface is caused to tilt with respect to the center axis L2, it is possible to correct the chamfering angle.

For example, the thickness of the edge surface may be measured by the measurement units 50F and 50R, thereby correcting the chamfering angle based on the measurement result. The measurement unit measures the thickness of the edge surface as the information regarding the shape of the edge surface of the eyeglass lens.

For example, when the thickness of the edge is large, the control portion 70 corrects the chamfering angle to be larger, and when the thickness of the edge is small, the control portion 70 corrects the chamfering angle to be smaller. Accordingly, it is possible to perform the chamfering at the suitable chamfering angle, even when the shape of an angular portion in which the chamfering is to be performed varies due to the thickness of the edge.

In the above description, the processing is performed by correcting the chamfering angle by the tilt angle of the edge surface. However, this is not limited thereto. For example, when the finishing is performed, the angle of the second rotational shaft is stored in the memory and the like. Then, when performing the chamfering, certain degrees of an angle can be added to the angle of the second rotational shaft at the time of the finishing stored in the memory, or certain degrees of an angle can be subtracted, thereby performing the chamfering.

According to such a method of the chamfering, it is possible to perform the chamfering corresponding to the change of the tilt angle of the edge surface. In other words, it is possible to perform the chamfering by causing the processing tool to come into contact with the angular portion of the edge surface at a suitable angle.

In the description above, it is possible to consider another method of preventing the processing tool from coming into contact with the bevel. As one thereof, for example, it is possible to consider a method in which the control portion 70 corrects the chamfering amount set in Step 3 so as to cause the processing tool not to come into contact with the bevel. In this case, the chamfering amount set in Step 3 is corrected to be smaller so as to cause the processing tool not to come into contact with the bevel in the control portion 70. In order to reduce the chamfering amount, there is a need to cause the relative distance between the rotational center axis L2 and the second rotational shaft to be larger. Therefore, as the relative distance therebetween becomes large, the processing tool 65*b* is separated farther from the bevel. Accordingly, the chamfering amount can be corrected to be smaller such the processing tool 65*b* does not come into contact with the bevel. Even in this method, it is possible to prevent the processing tool from coming into contact with the bevel.

Figure 20:
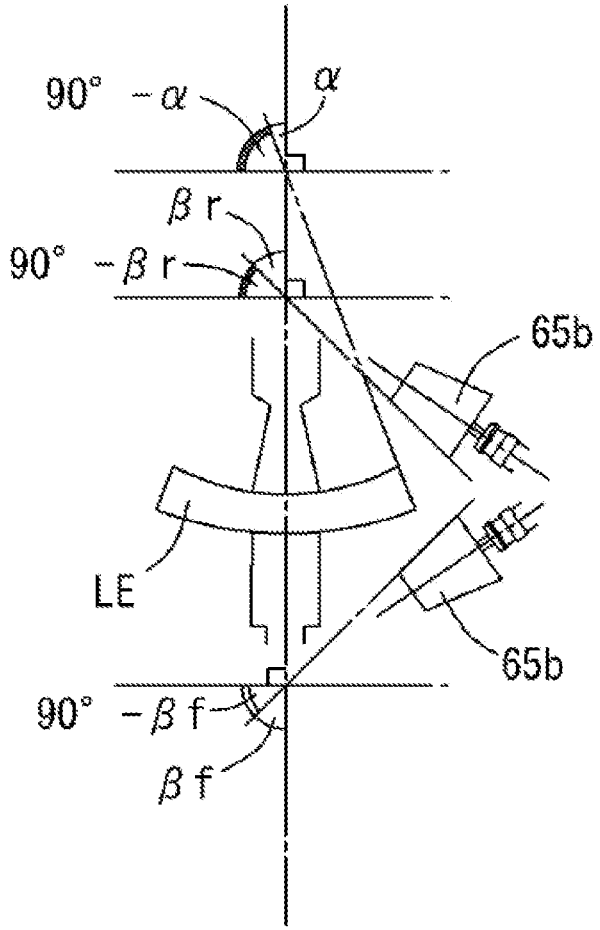
FIG. 20 is a diagram showing a chamfering angle.

In the above description, the chamfering angle is described to indicate the angle at which the cutting surface of the chamfering tool tilts with respect to the rotational center axis L2. However, this is not limited thereto. For example, as shown in FIG. 20, the chamfering angle may be the angle at which the cutting surface of the chamfering tool tilts in the direction perpendicular to the rotational center axis L2. In other words, a numeric value in which the chamfering angle β of the present embodiment is subtracted from 90 degrees may be used as the chamfering angle. In this manner, the chamfering angle may be acceptable as long as the tilt relationship between the processing tool surface of the lens processing tool and the rotational center axis L2, or the tilt relationship between the rotational shaft L1 and the rotational center axis L2 can be defined. The tilt angle of the edge can be similar thereto.

In the above description, when selecting the beveling or the plano-processing, an operator inputs which processing is to be performed. However, this is not limited thereto. For example, various processing steps may be selected in accordance with the eyeglass data sent from the host computer 1000 and the like. In this manner, an operator can be relieved from selecting the types of the processing each time the operator performs the processing.

In the above description, the chamfering angle is determined and is input by an operator. However, this is not limited thereto. For example, the chamfering angle may be stored in the memory in advance, or the chamfering angle may be acquired through the selection from the suitable memory by the control portion 70.

Similarly, the chamfering amount does not need to be input by an operator. As described above, the control portion 70 may acquire the chamfering amount through the selection from the suitable multiple chamfering amounts stored in the memory.

In the above description, the chamfering data is obtained after correcting the chamfering angle in Step 11. However, this is not limited thereto. For example, the chamfering data may be calculated with the input chamfering angle, and then, the chamfering angle may be corrected based on the tilt angle of the edge, thereby modifying the chamfering data.

What is claimed is:

1. An eyeglass lens processing apparatus comprising:

a first rotational shaft which is configured to hold and rotate an eyeglass lens;

a finishing tool which is configured to perform finishing on a rim of the eyeglass lens to have a target shape of the eyeglass lens;

a chamfering tool which is configured to perform chamfering on an angular portion of an edge of the eyeglass lens which is finished by the finishing tool;

a second rotational shaft, to which the chamfering tool is attached;

an adjustment unit which is configured to adjust a relative angle between the first rotational shaft and the second rotational shaft; and a processor which is configured to:

control driving of the adjustment unit;

set a chamfering angle which is an angle formed between a rotational center axis of the first rotational shaft and a processing tool surface of the chamfering tool when performing the chamfering;

acquire information regarding an edge surface shape of the eyeglass lens, the edge surface shape including a bevel and a portion to be chamfered;

correct the chamfering angle based on the information regarding the edge surface shape;

determine whether the bevel formed on the eyeglass lens would come into contact with the chamfering tool when performing said chamfering at said corrected chamfering angle;

further correct the chamfering angle based on determining if it is determined that the bevel would come into contact with the chamfering tool; and control the driving of the adjustment unit and adjust the relative angle between the first rotational shaft and the second rotational shaft to perform the chamfering based on the chamfering angle which is further corrected.

2. The eyeglass lens processing apparatus according to claim 1, wherein the processor is configured to acquire information regarding a tilt angle of the edge surface with respect to the rotational center axis of the first rotational shaft, and wherein the processor is configured to correct the chamfering angle based on the tilt angle of the edge surface.

3. The eyeglass lens processing apparatus according to claim 2, wherein the finishing tool includes a bevel-finishing tool which is configured to form a bevel on the edge of the eyeglass lens, and wherein the adjustment unit includes a bevel-finishing tool adjustment unit which is configured to adjust a relative positional relationship between the first rotational shaft and a third rotational shaft, to which the bevel-finishing tool is attached, wherein the processor is configured to:

acquire curve information of a lens front surface;

set an edge tilt angle for beveling which is a tilt angle of the edge surface for performing bevel-finishing, for each position of the target shape based on the acquired curve information of the lens front surface and the target shape;

control the bevel-finishing tool adjustment unit to perform beveling on the eyeglass lens based on the target shape and the edge tilt angle for beveling; and acquire the edge tilt angle for beveling for each position of the target shape as the tilt angle of the edge surface when chamfering.

4. The eyeglass lens processing apparatus according to claim 1, wherein the processor is configured to acquire information regarding a thickness of the edge surface; and correct the chamfering angle based on the thickness of the edge surface.

5. The eyeglass lens processing apparatus according to claim 1, wherein the processor is configured to acquire a tilt angle of the edge surface for each position of the target shape of the target shape; and correct the chamfering angle for each position of the target shape of the target shape based on the tilt angle of the edge surface which is acquired for each position of the target shape.

6. The eyeglass lens processing apparatus according to claim 1, wherein the processor is configured to perform comparison processing between at least a tapered angle of the chamfering tool and information regarding the bevel and determine whether the bevel is to come into contact with the chamfering tool based on the compared result.

7. The eyeglass lens processing apparatus according to claim 1, wherein the processor is configured to acquire an angle of a tilt surface of the bevel formed on the eyeglass lens with respect to the rotational center axis; and correct a relative angle of the second rotational shaft with respect to the rotational center axis so as to cause a relative angle of the processing tool surface of the chamfering tool with respect to the rotational center axis to be larger than the angle of the tilt surface of the bevel when the processor determines that the bevel is to come into contact with the chamfering tool such that the chamfering tool is prevented from coming into contact with the bevel.

8. The eyeglass lens processing apparatus according to claim 1, wherein the processor is configured to output a signal to notify an operator of a possibility that the chamfering tool is to come into contact with the bevel when the processor determines that the bevel is to come into contact with the chamfering tool.

9. The eyeglass lens processing apparatus according to claim 2, wherein the processor is configured to acquire the tilt angle of the edge surface based on processing control data which is computed for processing the eyeglass lens.

10. A non-transitory storage medium having an eyeglass lens processing program stored thereon and readable by a processor of an eyeglass lens processing apparatus, the eyeglass lens processing program, when executed by the processor, causing the eyeglass lens processing apparatus to:

when performing chamfering on an angular portion of an edge of an eyeglass lens which is finished by a finishing tool, set a chamfering angle which is an angle formed between a rotational center axis of a first rotational shaft which is configured to hold and rotate the eyeglass lens and a processing tool surface of a chamfering tool which is configured to perform chamfering on the angular portion of the edge of the eyeglass lens;

acquire information regarding an edge surface shape of the eyeglass lens with respect to the first rotational shaft, the edge surface shape including a bevel and a portion to be chamfered;

correct the chamfering angle based on the information regarding the edge surface shape which is acquired by the acquiring step;

determine whether the bevel formed on the eyeglass lens would come into contact with the chamfering tool when performing said chamfering at said corrected chamfering angle and further correct the chamfering angle based on determining if it is determined that the bevel would come into contact with the chamfering tool; and control driving of an adjustment unit which is configured to adjust a relative angle between the first rotational shaft and a second rotational shaft to which the chamfering tool is attached so as to adjust the relative angle between the first rotational shaft and the second rotational shaft based on the chamfering angle which is corrected by the correcting step.

11. A method for processing an eyeglass lens using the eyeglass lens apparatus of claim 1, comprising:

acquiring, by the processor of the eyeglass lens processing apparatus of claim 1, chamfering data;

determining, by the processor of the eyeglass lens processing apparatus, that a bevel formed on an eyeglass lens is to contact a chamfering tool based on the chamfering data; and adjusting, by the processor of the eyeglass lens processing apparatus, the relative angle between the first rotational shaft, that holds the eyeglass lens, and the second rotational shaft, to which the chamfering tool is attached, based on determining that the bevel formed on the eyeglass lens is to contact the chamfering tool to prevent the chamfering tool from contacting the bevel.

12. The method of claim 11, further comprising:

comparing, by the processor of the eyeglass lens processing apparatus, information regarding the bevel and information of an angle of a cutting surface of the chamfering tool; and wherein determining, by the processor of the eyeglass lens processing apparatus, that the bevel formed on the eyeglass lens is to contact the chamfering tool based on the chamfering data comprises:

determining, by the processor of the eyeglass lens processing apparatus, that the bevel formed on the eyeglass lens is to contact the chamfering tool based on comparing the information regarding the bevel and the information of the angle of the cutting surface of the chamfering tool.

13. The method of claim 11, further comprising:

acquiring, by the processor of the eyeglass lens processing apparatus, information associated with the chamfering tool; and wherein determining, by the processor of the eyeglass lens processing apparatus, that the bevel formed on the eyeglass lens is to contact the chamfering tool based on the chamfering data comprises:

determining, by the processor of the eyeglass lens processing apparatus, that the bevel formed on the eyeglass lens is to contract the chamfering tool based on the information associated with the chamfering tool.

14. The method of claim 11, further comprising:

comparing, by the processor of the eyeglass lens processing apparatus, a chamfering portion of the eyeglass lens and a position of an apex of the bevel;

and wherein determining, by the processor of the eyeglass lens processing apparatus, that the bevel formed on the eyeglass lens is to contact the chamfering tool based on the chamfering data comprises:

determining, by the processor of the eyeglass lens processing apparatus, that the bevel formed on the eyeglass lens is to contact the chamfering tool based on comparing the chamfering portion and the position of the apex of the bevel.

15. The method of claim 11, further comprising:

comparing, by the processor of the eyeglass lens processing apparatus, a first tilt angle at which a rear tilt surface of the bevel tilts and the center axis of the first rotational shaft; and wherein determining, by the processor of the eyeglass lens processing apparatus, that the bevel formed on the eyeglass lens is to contact the chamfering tool based on the chamfering data comprises:

determining, by the processor of the eyeglass lens processing apparatus, that the bevel formed on the eyeglass lens is to contact the chamfering tool based on comparing the first tilt angle at which a rear tilt surface of the bevel tilts and a center axis of the first rotational shaft.

16. A method for processing an eyeglass lens using the eyeglass lens processing apparatus of claim 1, comprising:

acquiring, by the processor, information regarding the edge surface shape;

determining, by the processor, whether a bevel formed on the eyeglass lens would come into contact with the chamfering tool based on the information regarding the edge surface shape; and adjusting, by the processor, the relative angle between the first rotational shaft and the second rotational shaft to prevent the chamfering tool from contacting the bevel based on determining whether the bevel formed on the eyeglass lens would come into contact with the chamfering tool.

17. The method of claim 16, further comprising:

determining, by the processor, that the chamfering tool would come into contact with the bevel formed on the eyeglass lens;

correcting, by the processor, the chamfering angle that was previously set; and wherein adjusting, by the processor, the relative angle between the first rotational shaft and the second rotational shaft comprises:

adjusting, by the processor, the relative angle between the first and the second rotational shaft based on correcting the chamfering angle that was previously set.

18. The method of claim 16, further comprising:

determining, by the processor, a position of an apex of the bevel; and wherein determining, by the processor, whether the bevel formed on the eyeglass lens would come into contact with the chamfering tool comprises:

determining, by the processor, whether the bevel formed on the eyeglass lens would come into contact with the chamfering tool based on the position of the apex of the bevel.

19. The method of claim 16, further comprising:

comparing, by the processor, information regarding the bevel and information of an angle of a cutting surface of the chamfering tool; and wherein determining, by the processor, whether the bevel formed on the eyeglass lens would come into contact with the chamfering tool comprises:

determining, by the processor, whether the bevel formed on the eyeglass lens would come into contact with the chamfering tool based on comparing the information regarding the bevel and information of an angle of a cutting surface of the chamfering tool.

20. The method of claim 16, further comprising:

determining, by the processor, whether the chamfering tool would come into contact with an apex of the bevel; and wherein adjusting, by the processor, the relative angle between the first rotational shaft and the second rotational shaft to prevent the chamfering tool from contacting the bevel comprises:

adjusting, by the processor, the relative angle between the first rotational shaft and the second rotational shaft to prevent the chamfering tool from contacting the bevel based on determining, by the processor, whether the chamfering tool would come into contact with the apex of the bevel.

* * * * *